US007997823B2

(12) United States Patent
Meyers

(10) Patent No.: US 7,997,823 B2
(45) Date of Patent: Aug. 16, 2011

(54) INJECTION-MOLDED PLASTIC NESTABLE SHELL FOR CONCRETE PARKING BUMPERS

(75) Inventor: Theodore W. Meyers, Barrington, IL (US)

(73) Assignee: Tuf-Tite, Inc., Lake Zurich, IL (US)

( * ) Notice: Subject to any disclaimer, the term of this patent is extended or adjusted under 35 U.S.C. 154(b) by 142 days.

(21) Appl. No.: 12/365,773

(22) Filed: Feb. 4, 2009

(65) Prior Publication Data

US 2009/0195002 A1 Aug. 6, 2009

Related U.S. Application Data

(60) Provisional application No. 61/026,722, filed on Feb. 6, 2008, provisional application No. 61/080,722, filed on Jul. 15, 2008.

(51) Int. Cl.
*E01F 13/00* (2006.01)

(52) U.S. Cl. ..... 404/6; 404/9

(58) Field of Classification Search ..... 404/6, 9, 404/12; 256/13.1

See application file for complete search history.

(56) References Cited

U.S. PATENT DOCUMENTS

| | | | | |
|---|---|---|---|---|
| 1,696,247 | A | 12/1928 | McManama | |
| 2,725,958 | A | 12/1955 | Porter et al. | |
| 2,779,543 | A | 1/1957 | Grönlund | |
| 3,619,457 | A | 11/1971 | Chandler et al. | |
| 4,142,814 | A * | 3/1979 | Sanchez | 404/7 |
| 4,348,133 | A | 9/1982 | Trent et al. | |
| 4,762,438 | A * | 8/1988 | Dewing | 404/6 |
| 4,854,767 | A * | 8/1989 | Sasaki | 404/6 |
| 5,011,325 | A * | 4/1991 | Antonioli | 404/6 |
| 5,429,448 | A * | 7/1995 | Ballesteros | 404/6 |
| 5,498,101 | A * | 3/1996 | Braverman | 404/6 |

(Continued)

FOREIGN PATENT DOCUMENTS

GB 1 497 860 1/1978

(Continued)

OTHER PUBLICATIONS

Page from Strike Products' Web site (http://www.striketool.com/EZ%20Form%20Bumpers.htm) entitled "EZ Form Bumper," understood to be publicly available at least as early as Feb. 5, 2007.

(Continued)

*Primary Examiner* — Raymond W Addie

(74) *Attorney, Agent, or Firm* — Marshall, Gerstein & Borun LLP

(57) ABSTRACT

A parking bumper shell that can be easily filled with a heavy form-filling material (such as concrete) to form a parking bumper is provided. The parking bumper shell may be injection molded from durable, brightly-colored, UV- and weather-resistant plastic. Undercuts, such as in the form of a plurality of undercut wings or z-puller pins, may be disposed on the interior of the parking bumper shell's top and side walls to aid in holding the parking bumper shell and the heavy filling material together. The parking bumper shell may also include internally projecting hollow extensions that are adapted to receive anchoring posts. While the parking bumper shell is being filled, it may be placed in a rigid frame which helps the shell to keep its shape during filling. The parking bumper shells are light-weight, nestable, and do not require internal steel rebar reinforcement, thereby greatly reducing transportation costs.

52 Claims, 17 Drawing Sheets

U.S. PATENT DOCUMENTS

| | | | | |
|---|---|---|---|---|
| 5,746,538 | A * | 5/1998 | Gunness | 404/6 |
| D420,928 | S | 2/2000 | Spiller | |
| 6,086,285 | A * | 7/2000 | Christensen | 404/6 |
| 6,383,420 | B1 | 5/2002 | Mohr | |
| D458,177 | S | 6/2002 | Spiller | |
| D460,013 | S | 7/2002 | Spiller | |
| D461,138 | S | 8/2002 | Spiller | |
| 6,951,434 | B2 * | 10/2005 | Yodock et al. | 404/6 |
| 7,445,403 | B2 * | 11/2008 | Williams et al. | 405/107 |
| 7,527,128 | B2 * | 5/2009 | Buzzoni | 188/5 |
| 7,547,157 | B2 * | 6/2009 | Yodock et al. | 404/6 |
| 2004/0146347 | A1 * | 7/2004 | Davis et al. | 404/6 |
| 2005/0017403 | A1 | 1/2005 | Ollendick et al. | |

FOREIGN PATENT DOCUMENTS

| | | | |
|---|---|---|---|
| WO | WO-02/48462 | A1 | 6/2002 |
| WO | WO-02/077368 | A1 | 10/2002 |

OTHER PUBLICATIONS

Digital photos of Strike Products, "EZ Form Bumper," understood to be on sale at leas as early as Feb. 5, 2007.

* cited by examiner

INJECTION-MOLDED PLASTIC NESTABLE SHELL FOR CONCRETE PARKING BUMPERS

REFERENCE TO RELATED APPLICATIONS

This application claims the benefit of the filing dates of U.S. Provisional Application No. 61/026,722, filed Feb. 6, 2008, and U.S. Provisional Application No. 61/080,722, filed Jul. 15, 2008, for all subject matter disclosed in those applications, the entirety of each of which is incorporated herein by reference.

FIELD OF THE DISCLOSURE

This disclosure relates generally to parking bumper shells for use in making parking bumpers for a parking lot, and, more particularly, to a parking bumper shell that can be easily transported and filled to create a parking bumper.

BACKGROUND

Typically, parking bumpers are made primarily of concrete with internal, axially-extending steel reinforcing bar (rebar) reinforcement and have a generally trapezoidal cross-section or half-octagonal cross-section. Parking bumpers are usually held in place with respect to a parking space or otherwise by gravity, as well as through the use of rebar or other inexpensive metal rods which anchor the parking bumper to the parking lot surface. Mating channels may be provided through the parking bumper with sufficient clearance to allow a length of rebar or a similar metal rod to pass through the parking bumper. Typically, the parking bumper is positioned in the parking lot, and then anchoring posts are driven through the mating channels into the parking lot surface to secure the parking bumper. The parking bumper may be moved to a desired location on a concrete, asphalt, or otherwise paved surface using, for example, front end loaders, cranes, or other common hauling or moving equipment.

Parking bumpers may sometimes be painted. For example, parking bumpers are often painted yellow. Additionally, parking bumpers may be painted with lettering to designate the characteristic of the parking spot, such as the parking spot being for "visitors" or "handicapped". Painting and labeling, of course, require extra materials and labor.

It is difficult and expensive to transport concrete parking bumpers, as described above, to a given parking lot location. Moreover, the paint or lettering on parking bumpers fades and chips away quickly. As a result, painted bumpers require frequent maintenance. Another drawback of conventional concrete parking bumpers is their vulnerability to the outdoor elements. The freeze-thaw cycle and road salt, particularly in colder climates with snowy and icy winters, degrade concrete parking bumpers, causing them to crack, crumble, chip, or undesirably crush when impacted by a car tire.

The parking bumper shells of the present disclosure overcome these and other shortcomings of conventional concrete parking bumpers. As compared to conventional parking bumpers, the parking bumper shells of the present disclosure are inexpensive to produce, light-weight, and take up less cargo space when nested. Moreover, the parking bumper shells can be formed using material that is already of the desired color, for example, yellow plastic, and preferably, UV stabilized. Thus, the need to continually maintain and paint the parking bumper is eliminated.

SUMMARY OF THE DISCLOSURE

The parking bumper shells of the present disclosure are preferably made of injection molded plastic and include a top wall, first and second side walls, and first and second end walls. Preferably, the parking bumper shells are formed such that they have a cross-sectional shape of a half-octagon. Accordingly, each of the first and second side walls preferably has a first portion that is outwardly tapered and a second portion that extends vertically from a bottom of the first portion.

A lip may extend substantially along each of the first and second side walls to aid in keeping the filling material within the parking bumper shell and to provide a surface upon which to level the filling material after it is poured. The lip may be located at a bottom edge of the side walls and extends inwardly approximately ¼ inch from the side wall.

Internal ribs that extend substantially along the length of the side walls may also be provided on an interior of the first and second side walls. Like the lip, the internal ribs aid in keeping the filling material within the parking bumper shell. The internal ribs project inwardly approximately ¼ inch from the first and second side walls. The internal ribs may be spaced evenly along a height of the side wall.

The top wall may include inwardly projecting elongate knock-out pins. Each of the elongate knock-out pins may aid in keeping the filling material within the parking bumper shell by having an undercut along a portion of the length of the pin, into which the concrete, or other heavy, hardenable filling material, may creep. A portion of the elongate knock-out pins has a reduced thickness, thereby providing a notch or detent to retain the heavy filling material therein, and provide resistance to maintain the heavy filling material within the parking bumper shell. These knock-out pins are referred to herein as "z-puller pins," due to the cross-sectional appearance of the pins and a preferable shape of the detents therein, although it will be understood that different profiles or detent shapes than those shown in the accompanying drawings (e.g. sawtoothed, stair-step, wave-formed, etc.) may be employed without departing from the scope of the present disclosure and appended claims. The z-puller pins are thus elongate knock-out pins wherein a portion of the elongate knock-out pin has a thickness that reduces at a constant rate, to form a z-shaped notch or detent in the pin. The pins may be supported by one or more ribs, or instead by an enlarged base section, which help anchor the z-puller pin to the wall on which it is attached. In a preferred embodiment, a plurality of z-puller pins are provided in the parking bumper shell on the underside of the top wall.

The top wall may further include internally projecting hollow extensions. The hollow extensions may be conical, and include a ledge and a shoulder to allow for proper seating of a washer, an anchoring post, and a cap within a top portion of the hollow extension. Each of the hollow extensions may be further provided with a neck and inwardly projecting fins. The neck and inwardly projecting fins may be disposed at a lower portion of the hollow extension and can aid in securing the anchoring post within the hollow extension. The inwardly projecting fins may be oriented to form a keyway, which allows a lifting tool with an L- or T-shaped extension to be inserted to assist in moving the filled parking bumper. The conical hollow extensions may each include at least one annular bead on an exterior thereof. Like the notch or detent in the z-puller pin, and the internal ribs, the annular bead serves to retain concrete or other heavy form-setting material in the parking bumper shell.

A parking bumper of the present disclosure may be formed using one of the parking bumper shells of this disclosure. To form a parking bumper, the parking bumper shell may be inverted and filled with any suitable form-setting heavy filling material, for example, concrete. The filling material may be leveled using the bottom peripheral edge of the side and end walls as a guide for a trowel or similar leveling tool.

Because the weight of the filling material may cause the first and second walls of the parking bumper shell to bow outward during filling, resulting in a parking bumper with sides that are not parallel, planar and square, a removable rigid casting frame may be used to support the parking bumper shell during filling of the parking bumper shell and curing of the heavy filling material within. Before filling, the parking bumper shell is inverted and lowered into the rigid frame. The rigid frame is sized just large enough to allow the parking bumper shell to slide into place within the frame. Heavy filling material is then poured into the parking bumper shell, and the filler material is leveled (using a trowel or similar straight-edged tool) with the top of the rigid frame. The side walls of the rigid frame may be of a height equal to that of the parking bumper shell within, or preferably, may be slightly higher, such that the completed parking bumper sits atop a thin base pad of additional filler material. The base pad embeds the bottom peripheral free edge of the parking bumper shell's end walls and side walls in filler material.

Once the filling material is solidified, the parking bumper is turned upright and properly positioned on the parking lot surface. When the parking bumper is placed upright for installation, the base pad (if provided) elevates the plastic shell off the ground slightly to prevent damage to the plastic parking bumper shell as the completed parking bumper is maneuvered into place. Finally, anchoring posts may be driven through the hollow extensions and into the parking lot surface to permanently hold the parking bumper in place.

Parking bumpers formed using the parking bumper shells of the present disclosure are virtually impervious to typical outdoor elements, such as the freeze-thaw cycle, and resistant to degradation even after long exposure to road salt. When formed of injection molded UV stabilized plastic, the parking bumper shells of the present disclosure also advantageously retain their bright color for many years, even after constant exposure to direct sunlight.

DETAILED DESCRIPTION OF THE PREFERRED EMBODIMENTS

Provided is a parking bumper shell and method of making parking bumpers using the parking bumper shell. The parking bumper shell may be formed from any suitable material. For example, the parking bumper shell may be formed from a plastic. Preferably, the parking bumper shell is formed using injection molded plastic, and most preferably, injection molded UV stabilized plastic. The parking bumper shell may be painted or formed from a dyed material. For example, the parking bumper shell may be formed using a plastic with a yellow color.

Figure 1:
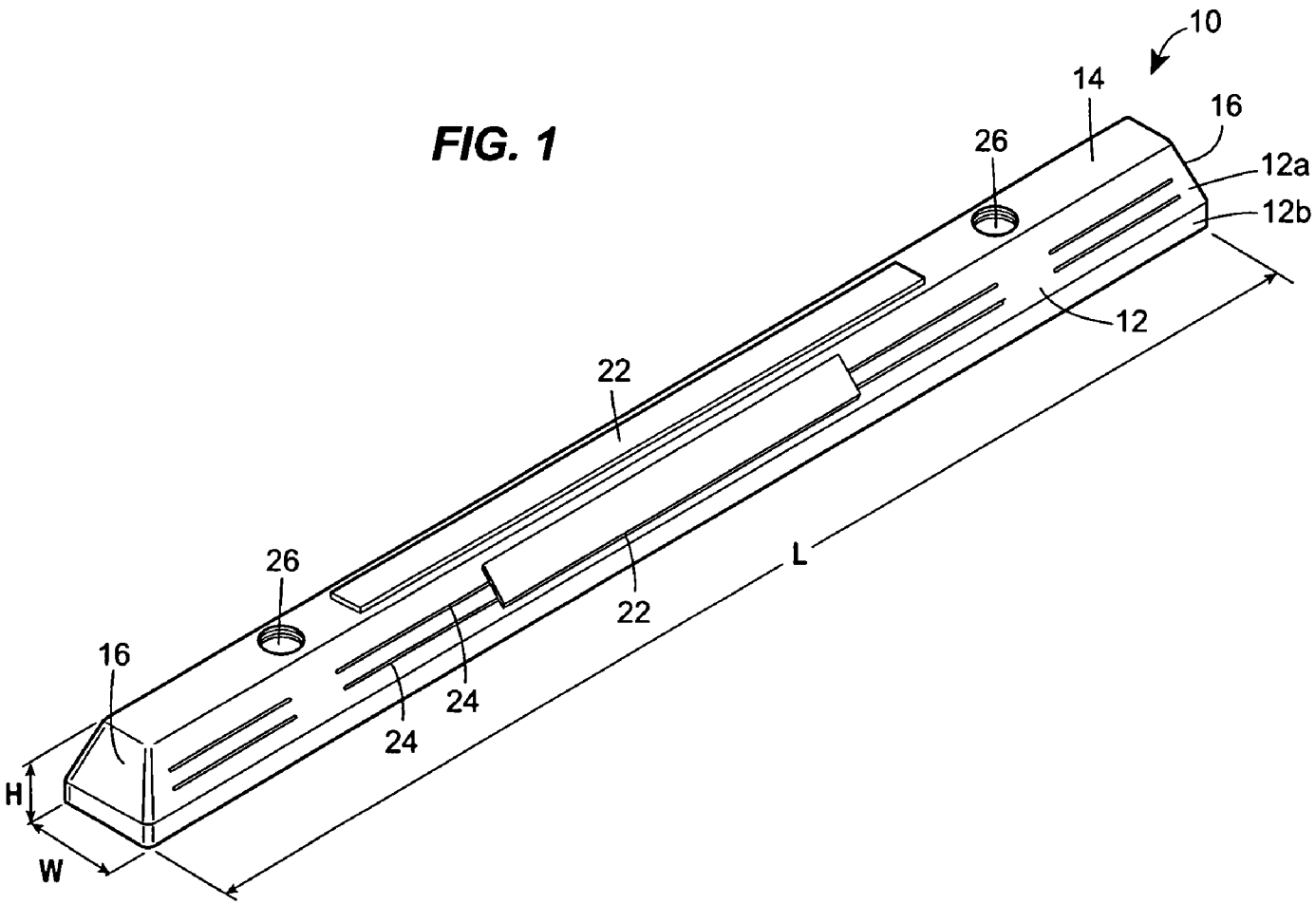
FIG. 1 is a perspective view of a parking bumper shell of the present disclosure.

Referring to FIG. 1, the parking bumper shell 10 has a height H, width W, and a length L. The length L of the parking bumper shell 10 may be greater than the height H of the parking bumper shell 10. Preferably, the length L is either three feet or 6 feet. A cross-section of the parking bumper shell 10 may be, for example, a semi-circle, a trapezoid, or any other suitable shape. Preferably, as shown in FIG. 1, the parking bumper shell 10 has a half-octagonal cross-sectional shape.

The parking bumper shell 10 has a top wall 14. First and second side walls 12 are operatively coupled to, and respectively extend from, opposite sides of the top wall 14. First and second end walls 16, having a shape that substantially corresponds to the cross-sectional shape of the parking bumper shell 10, are operatively coupled to and extend from opposite sides of the top wall 14. The first and second end walls 16 connect adjacent ends of the respective first and second side walls 12, so as to form an open-bottom chamber. The side walls 12 of the parking bumper shell 10 may be substantially planar. Preferably, the first and second side wall 12, the top wall 14, and the first and second end walls 16 are approximately ⅛ inch thick.

The first and second side walls 12 may each include an outwardly tapered first portion 12*a* and a generally vertical second portion 12*b*. Preferably, the outwardly tapered first portion 12*a* may be disposed above the generally vertical second portion 12*b*.

Figure 2:
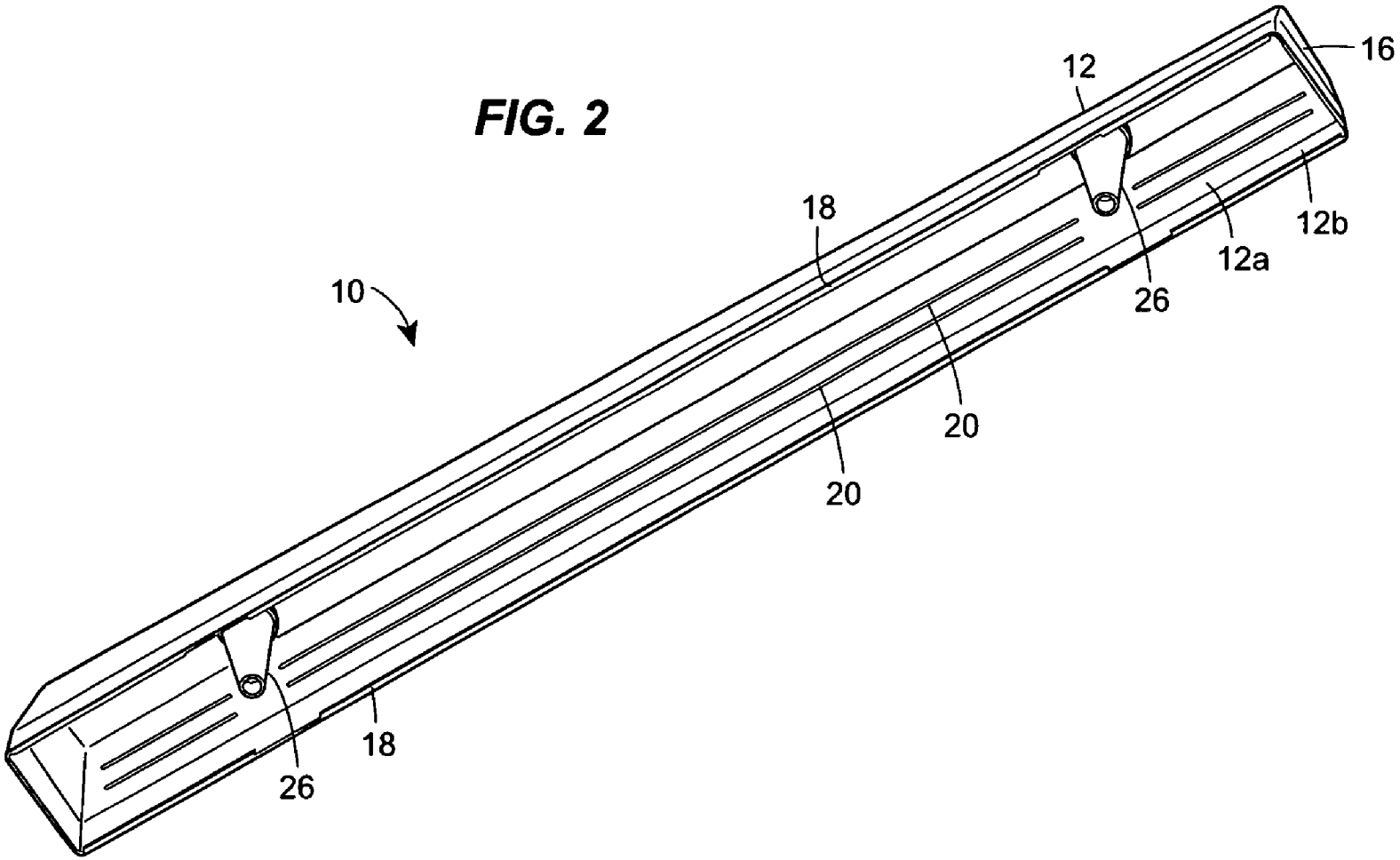
FIG. 2 is a perspective view of the interior of the parking bumper shell, showing the parking bumper shell with internal ribs.

Referring to FIG. 2, the first and second side walls 12 may each include an inwardly projecting lip 18. The lip 18 may be disposed at a bottom of the side wall 12. For example, the lip 18 may be disposed and operatively coupled to a bottom end of the generally vertical second portion 12*b*. The lip 18 may extend substantially along a length of the side wall 12. Preferably, the lip 18 projects inwardly approximately ¼ inch from the side wall 12. When forming a parking bumper using the parking bumper shell 10, the lip 18 may help to maintain a heavy filling material, such as concrete, within the parking bumper shell 10. Furthermore, the lips 18 provide co-planar surfaces that can be used as guides to level the filling material after pouring. For example, a trowel can be placed against the lips 18; the lips 18 will hold the trowel level when the trowel is dragged across the parking bumper shell 10 to level surface of the filling material.

Additionally, the first and second side walls 12 may each include one or more internal ribs 20 that project inwardly from the first and second side walls 12. The internal ribs 20 can also aid in holding the heavy filling material within the parking bumper shell 10 when a parking bumper is formed. The internal ribs 20 may also provide stability and structural rigidity to the overall parking bumper shell 10 to help the parking bumper shell 10 maintain its shape during transit. The internal ribs 20 may extend substantially along the length of the side walls 12. The internal ribs 20 may have, for example, a semi-circular cross-section, a trapezoidal cross-section, a triangular cross-section, a rectangular cross-section, or any other suitable cross-sectional shape. Preferably, the internal ribs 20 project inwardly approximately ¼ inch from the side walls 12.

If more than one internal rib 20 is provided, the internal ribs 20 may be spaced along a height of the side walls 12. The internal ribs 20 may, for example, be spaced equally along the height of the side walls 12. Preferably, the internal ribs 20 are disposed and operatively coupled to the interior of the outwardly tapered first portion 12*a* of the side walls 12. More preferably, two internal ribs 20 are provided and are equally spaced along the height of the outwardly tapered first portion 12*a* of the side walls 12.

Figure 16:
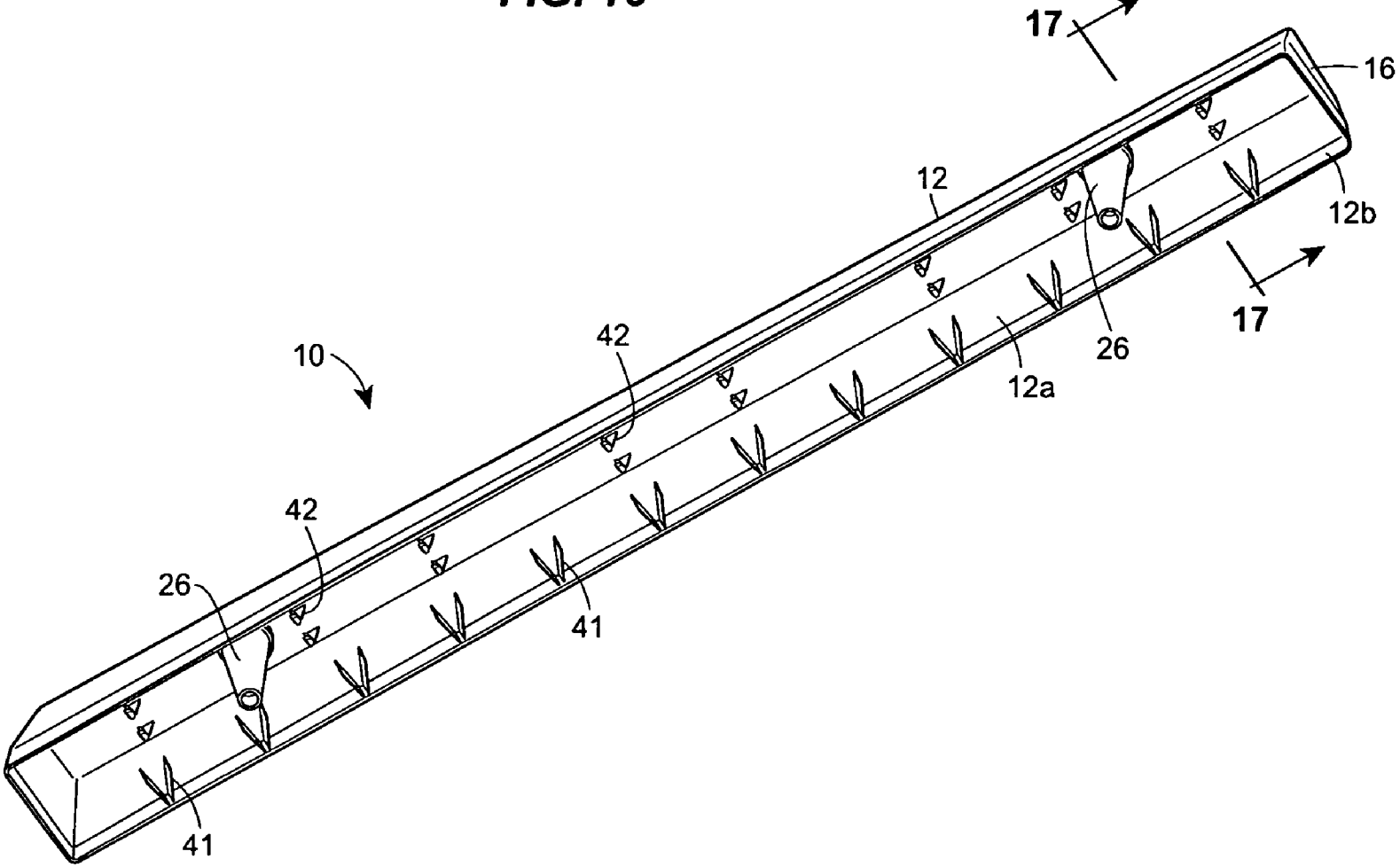
FIG. 16 is a perspective view of the interior of a second embodiment of the parking bumper shell, showing the parking bumper shell with undercut wings and z-pullers.
Figure 17:
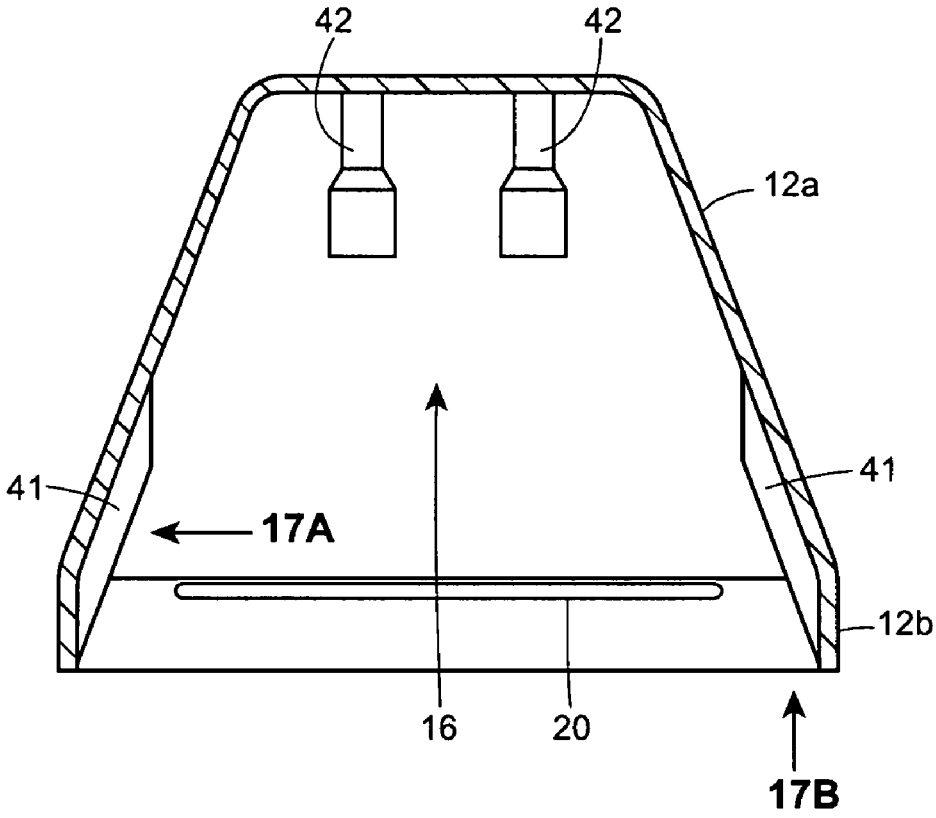
FIG. 17 is a cross-sectional view of the second embodiment of the parking bumper shell, showing the undercut wings and z-pullers.
Figure 17A:
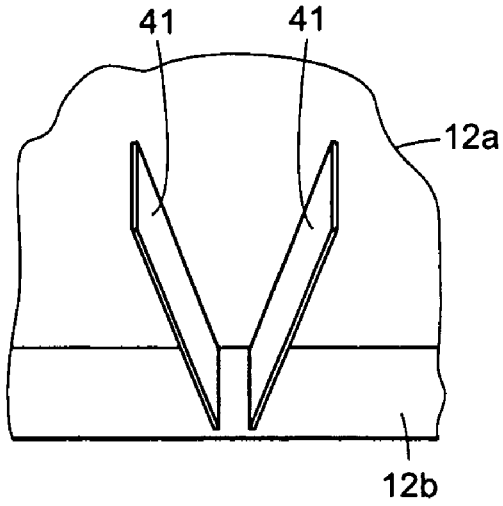
FIGS. 17A and 17B are enlarged views of a pair of undercut wings.
Figure 17B:
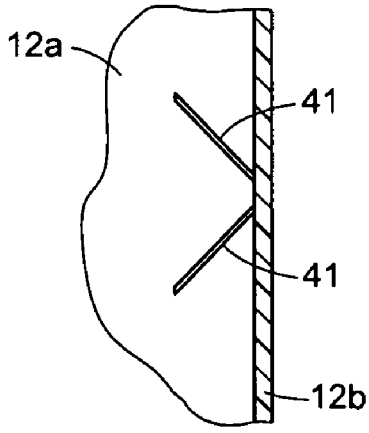

Referring to FIGS. 16 and 17, the side walls 12 may also be equipped with undercut wings 41 to be embedded into the heavy filling material, and to thereby help hold and secure the side walls 12 of the parking bumper shell 10 against the heavy filling material cured within. The undercut wings 41 also lend strength and stability to side wall 12 prior to filling, e.g. during shipment or storage. The undercut wings 41 are planar and finlike, and extend from the interior of the side wall 12 at an acute angle thereto. A variety of acute angles may work acceptably, but an angle of 56.3 degrees between the undercut wing 41 and second side wall 12*b* has been found to yield acceptable results. Though the undercut wings 41 may be formed of any shape, they are preferably of a planar and parallelogram shape that will not interfere with nested stacking of multiple parking bumper shells.

Preferably, the undercut wings 41 are arranged in pairs, with the undercut wings 41 in a given pair oriented at an angle to one another. The acute angle between the undercut wings 41 and the side walls 12 traps a "wedge" of heavy filler material in the recess between undercut wing 41 and the side wall 12. When the side wall 12 is pulled away from the heavy filler material, that "wedge" resists outward motion of the undercut wing 41 and, therefore, of the side wall 12 on which the undercut wing 41 is mounted. Further, orienting each of the undercut wings 41 within a pair in substantially different planes (e.g. at least 60 degrees apart) from one another helps the undercut wing pair to resist forces in a variety of directions. For instance, pulling the side wall 12 in a direction parallel to one undercut wing 41 will encounter resistance from the other undercut wing 41 in the pair. Additionally, the plane of each undercut wing 41 may simultaneously be oriented perpendicular to the base of the parking bumper shell 10. This allows the undercut wings 41 to simply slide out of the injection molding core (not shown) when the parking bumper shell 10 is removed, minimizing cost of manufacture by greatly reducing mold complexity and eliminating the need for so-called "collapsing" parts on the mold core. This reduces the wear and tear on injection molding machinery greatly. Resistance to vertical forces tending to separate the parking bumper shell 10 from the heavy filler material is provided by the z-pullers (described below).

Preferably, a plurality of undercut wing pairs may be used along the length of the side wall 12 to help securely keep the entire side wall 12 tight against the heavy filler material once the filler material has set. While no undercut wings 41 are provided on the end wall 16, additional undercut wings can be so provided, if desired; due to their short length, the end walls 16 do not tend to pull away from the heavy filler material significantly.

Referring again to FIG. 1, a logo plate or label 22 may be provided on an exterior of the top wall 14 and either one or both of the side walls 12. The logo plate or label 22 may be adapted to receive lettering, symbols, or any other image or sign. For example, the logo plate or label 22 may be decorated with text or symbols designating the parking space by a number or as "Handicapped" or "Reserved". During injection molding of the parking bumper shell 10, a steel molding cavity (not shown) may be provided with a removable plate (not shown) for molding the logo plate 22 directly onto the parking bumper shell 10. Depending on the depth of the portion of the cavity used to form each of the logo plates 22, the logo plates may be raised (as shown in FIG. 1), flush with the exterior of the parking bumper shell 10, or recessed into the parking bumper shell 10. Alternatively, a weather- and fade-resistant adhesive label made of a thin, flexible material, such as acrylic tape pre-printed with text or symbols, may be placed on the parking bumper shell after manufacture. The exterior of either or both of the side walls 12 may further include one or more exterior ribs 24 that extend along the length of the side walls 12.

Figure 18:
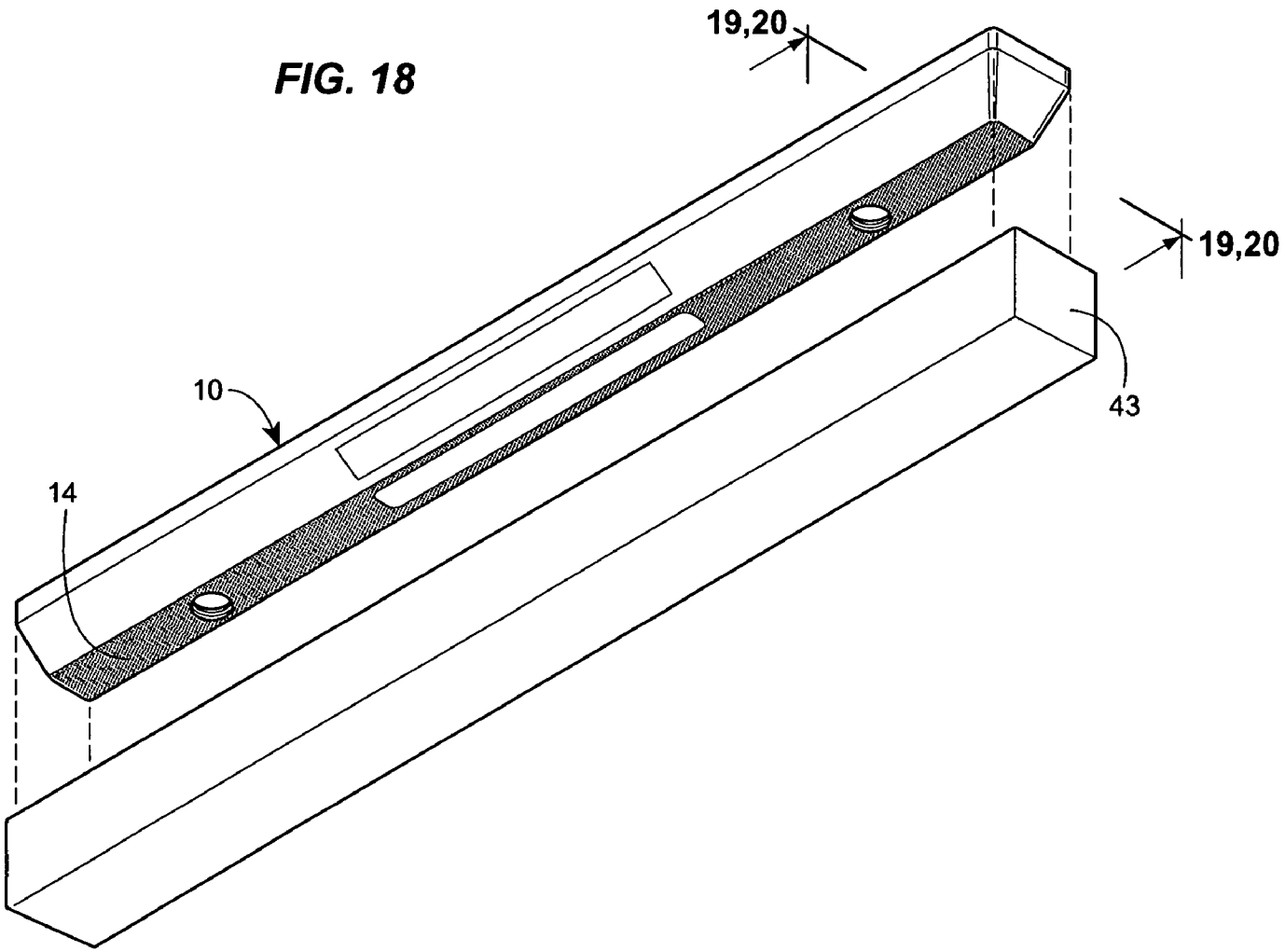
FIG. 18 is a view of a parking bumper shell and a rigid casting frame member.

Referring to FIG. 18, all or part of the parking bumper shell 10 exterior surface may be textured with a non-skid texture pattern or coating. Any commonly available non-skid texture pattern or coating material may be employed. The non-skid texture pattern may be molded into the parking bumper shell or may be applied after molding in the form of an adhesive sheet or coating. The parking bumper shell 10 of FIG. 18 has a non-skid texture pattern molded into the top wall 14, with a rectangular space reserved for indicia, e.g. a label plate, parking directive, or company logo.

Figure 3:
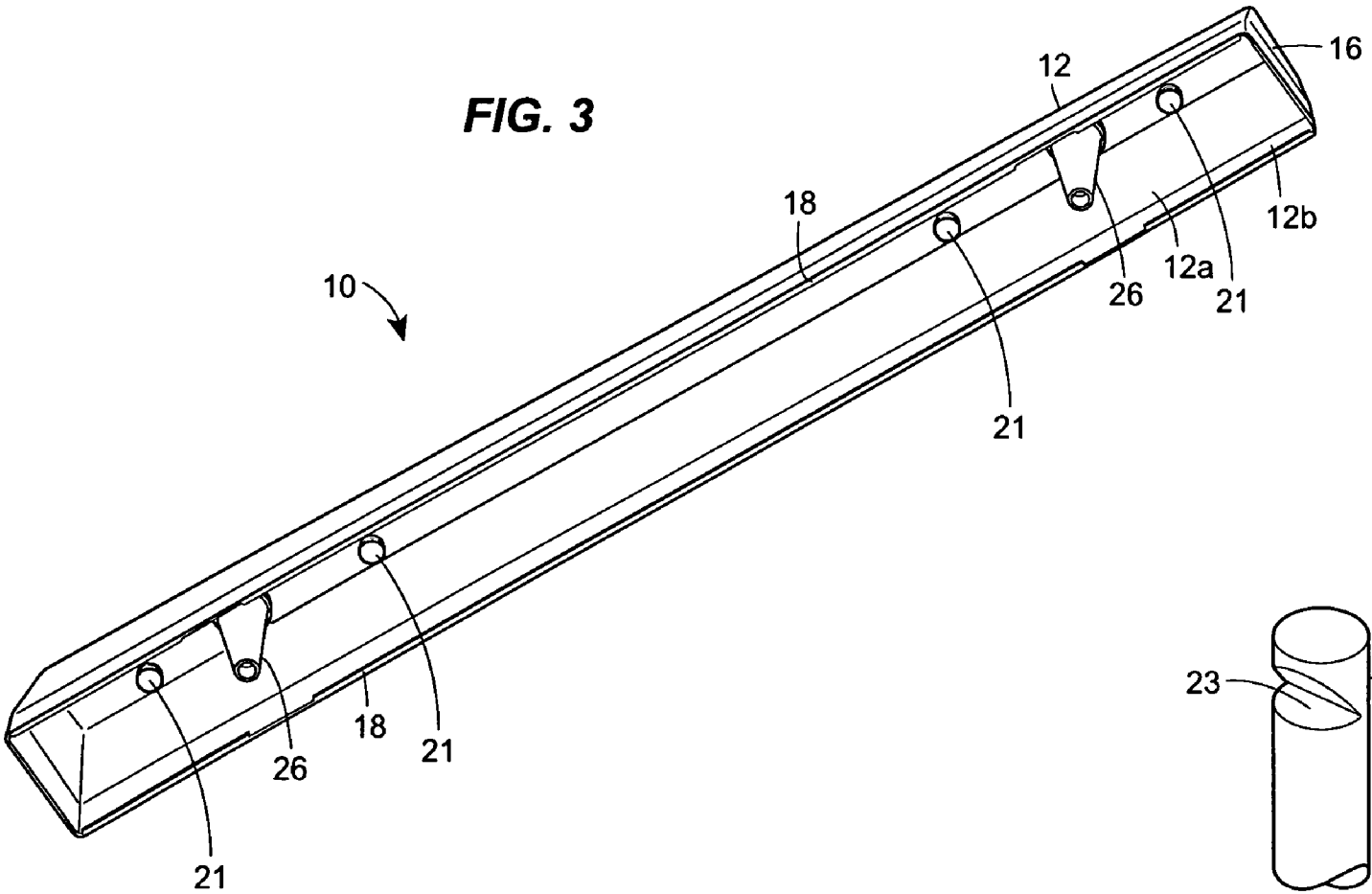
FIG. 3 is a perspective view of the interior of the parking bumper shell, showing the parking bumper shell with a plurality of elongate knock-out pins.
Figure 5:
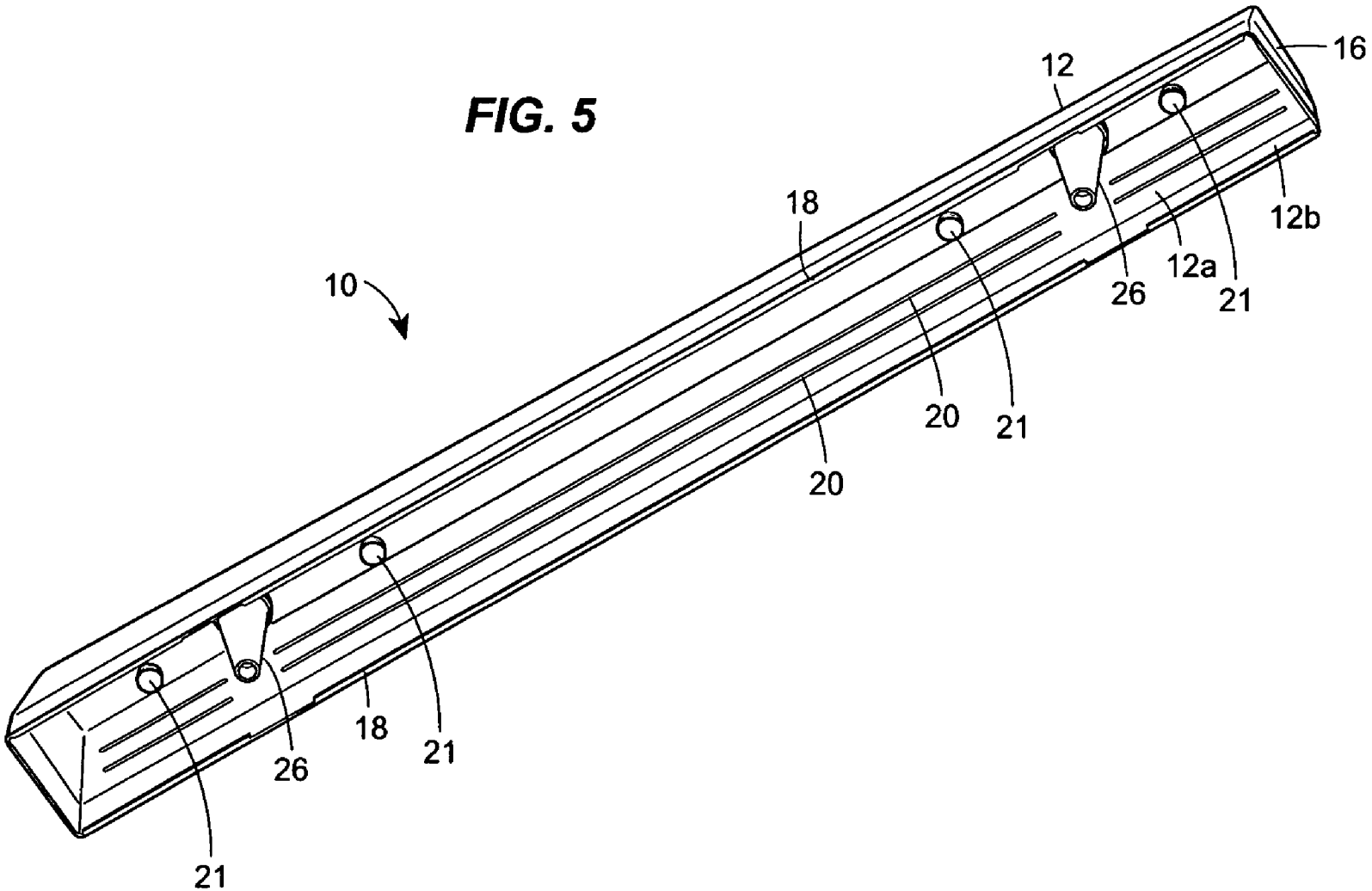
FIG. 5 is a perspective view of the interior of the parking bumper shell, showing the parking bumper shell with internal ribs and a plurality of elongate knock-out pins.

Referring to FIGS. 3 and 5, the top wall 14 may include one or more elongate knock-out pins 21 that extend inwardly from the top wall 14. Each of the elongate knock-out pins 21 extends inwardly (i.e. has a length of) approximately ⅜ inch. The elongate knock-out pins 21 may be approximately ⅜ inch thick. The elongate knock-out pins 21 may, however, have any other suitable length or thickness. The elongate knock-out pins 21 may have, for example, a rectangular cross-section, octagonal cross-section, or any other suitable cross-sectional shape. Preferably, the elongate knock-out pins 21 have a circular cross-sectional shape.

Figure 4:
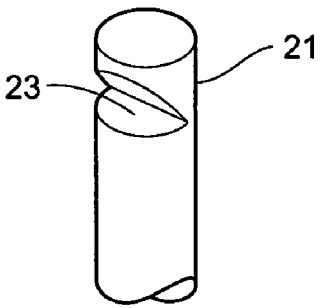
FIG. 4 is a perspective view of an inverted elongate knock-out pin.
Figure 21A:
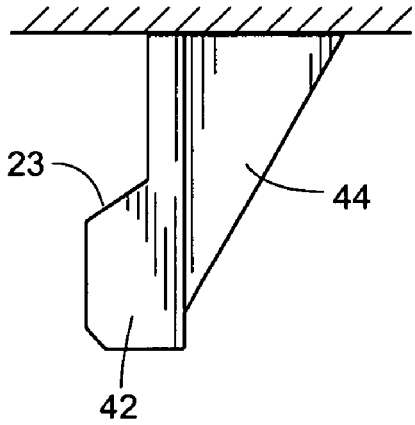
FIGS. 21A, 21B, and 21C are orthogonal views of a z-puller with a support rib.
Figure 21B:
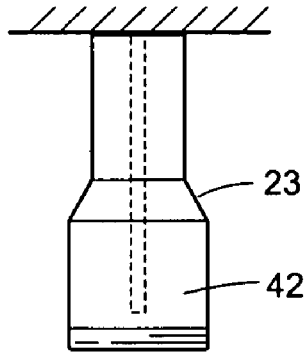
Figure 21C:
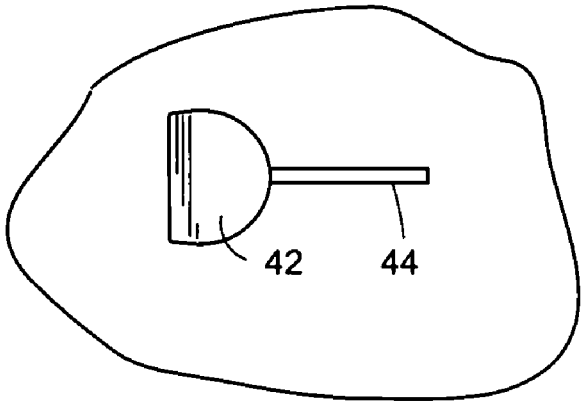
Figure 22:
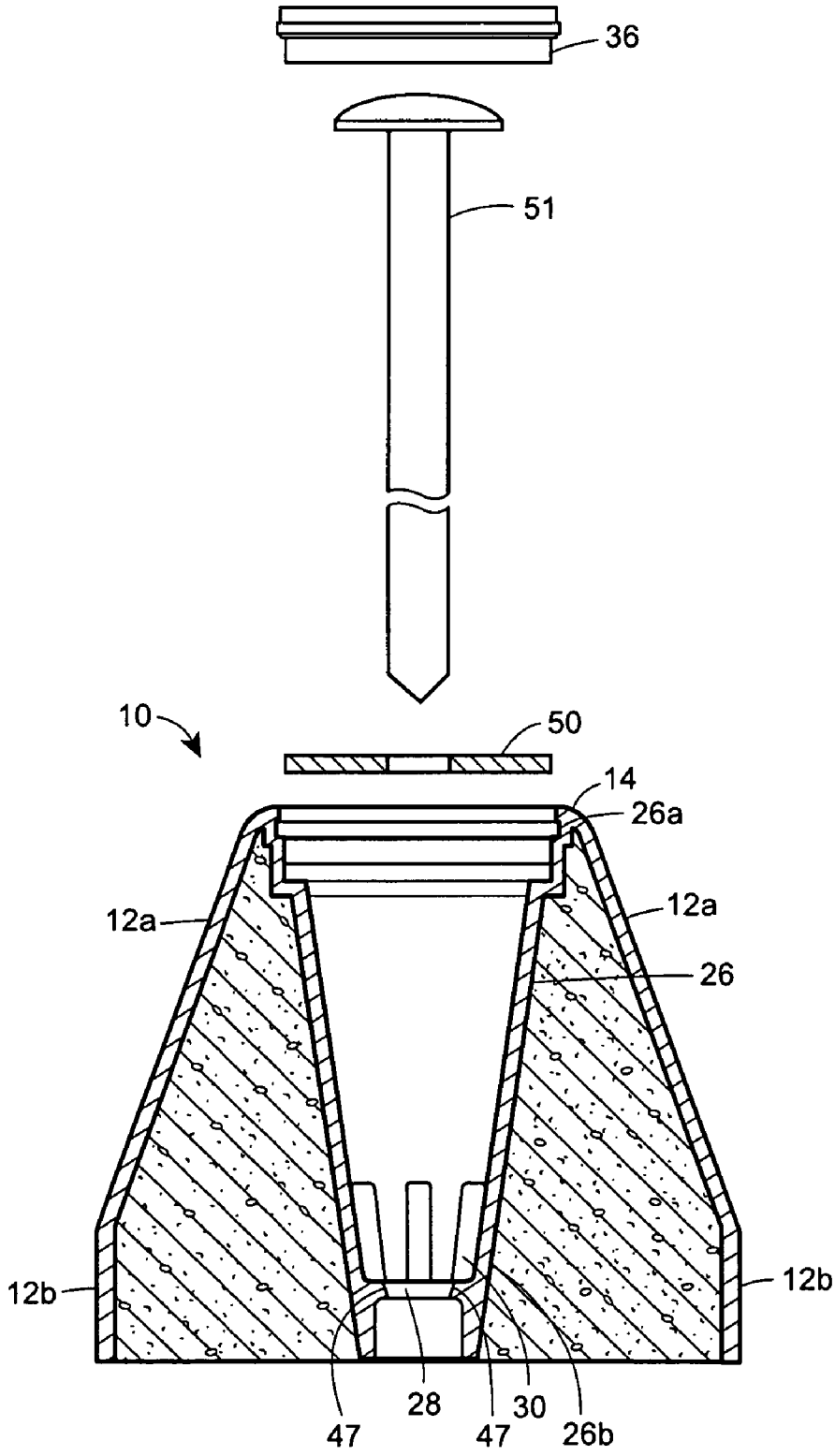
FIG. 22 is an exploded, cross-sectional view of the parking bumper with anchoring post, washer, and cap.

Like the internal ribs 20, the elongate knock-out pins 21 (also referred to herein as "z-puller pins" due to the cross-sectional shape of notches or detents 23 therein) can facilitate holding the form-setting heavy material within the parking bumper shell 10 when a parking bumper is formed. Referring to FIG. 4, a portion of the elongate knock-out pins 21 has a reduced thickness, thereby providing a notch or detent 23, permitting heavy filling material to creep therein, and when hardened, provide resistance to maintain the heavy filling material within the parking bumper shell 10. Each z-puller pin is an elongate knock-out pin 21, wherein a portion of the elongate knock-out pin 21 has a thickness that reduces at a constant rate to form the z-shaped notch or detent 23. The elongate knock-out pins 21 may have any other suitably shaped notch or detent 23 for retaining heavy filling material therein. For example, the elongate knock-out pins 21 may have a square, rectangular, or rounded notch or detent 23. FIG. 21A, 21B, and 21C show three different views of a z-puller pin 42 with a support rib 44 attached. The support rib 44 is approximately triangular in shape and extends from the interior of top wall 14 to the side of z-puller pin 42. The support rib 44, if used, helps to lend structural strength and stability to the z-puller pin 42. Alternatively, the z-puller pin 42 may be supported with an increased diameter base member, to provide extra support (not shown). As shown in FIG. 3, the elongate knock-out pins 21 may be provided as a substitute for the internal ribs 20. Alternatively, as shown in FIG. 5, the elongate knock-out pins 21 may be provided in addition to the internal ribs 20.

At a thinnest point, and by way of example only, the elongate knock-out pin 21 may have a thickness at the notch or detent 23 of approximately half its overall thickness, such as 3/16 inch for an elongate knock-out pin 21 having an overall thickness of ⅜ inch.

If more than one elongate knock-out pin 21 is provided, the elongate knock-out pins 21 may be spaced evenly along the interior of the top wall 14. In the embodiment of FIG. 3, four elongate knock-out pins 21 are provided and spaced along the interior of the top wall 14 such that two elongate knock-out pins 21 are equally spaced from a respective end wall 16, and two elongate knock-out pins 21 are equally spaced from a respective hollow extension 26. In the embodiment of F*igure* 16, eight pairs of knockout pins 42 with support ribs are spaced across the length of the interior of top wall 14. Additional configurations, attachment locations, and alignments of such knockout pins may be used, as desired.

The elongate knock-out pins 21 may be used for conventional injection molding purposes, such as facilitating removal of the injection molded parking bumper shell 10 from a steel injection mold core. However, it is recognized that other means of facilitating removal of the injection molded parking bumper shells 10 from an injection mold cavity may be employed, such as stripper bars, as an alternative to knock-out pins. Thus, while the term "elongate knock-out pins" is used herein, it is not intended to be limited to any operational requirements in terms of the manner in which the parking bumper shell 10 of the present disclosure is manufactured or removed from an injection mold core.

Due to the manner in which the detents are imparted to the elongate knock-out pins 21 during injection molding, it may be necessary when removing the injection molded parking bumper shell 10 from the mold core to pull the parking bumper shell 10 slightly up to provide clearance of portions of core of the mold used to form the notch or detents of the knock-out pins 21, before pulling the parking bumper shell 10 out of the mold.

Figure 6:
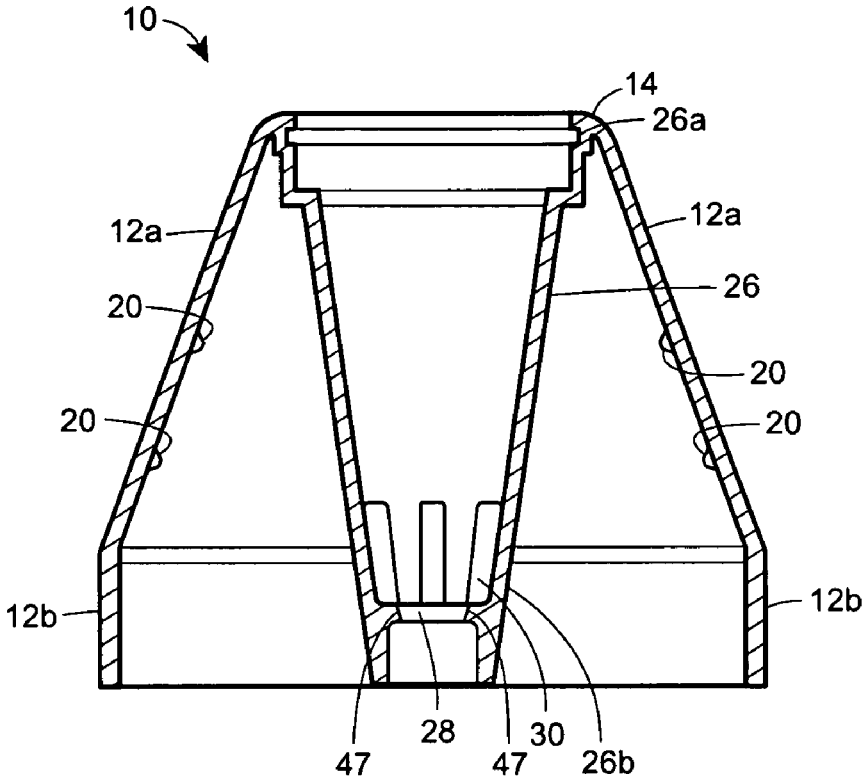
FIG. 6 is a cross-sectional view of the parking bumper shell of FIG. 1, showing the hollow extension.

Referring to FIGS. 2 and 6, the top wall 14 may include one or more hollow extensions 26 that extend inwardly from the top wall 14. The hollow extensions 26 are configured to receive an anchoring post (not shown) when the parking bumper is formed. The hollow extension 26 may have a height substantially equal to the height H of the parking bumper shell 10, or may have a slightly smaller height such that the hollow extension 26 does not touch the ground (and cause unwanted rocking of the parking bumper) when the parking bumper shell is placed on the ground upright. Preferably, the parking bumper shell 10 has two conically-shaped hollow extensions 26 that extend inwardly from the top wall 14. Each of the hollow extensions 26 may have, however, any suitable shape. As shown in FIG. 2, the two hollow conical extensions 26 may be spaced along the top wall 14 such that they are equally spaced from a respective end wall 16. Alternatively, the hollow extensions 26 may be spaced to conform to the spacing of existing anchoring posts already provided in a given parking lot.

As shown in FIGS. 12-15, in addition or as an alternative to the "z-puller" elongate knock-out pins 21 or the internal ribs 20, the conical extensions 26 may be provided with at least one annular bead 25, at least partially about its circumference. Preferably, the annular bead 25 has a thickness on the order of 0.02 to 0.03 inch. The annular bead 25 can facilitate holding the concrete or other form-setting heavy material within the parking bumper shell 10, by serving as an undercut in a manner similar to the internal ribs 20 or the notches or detents 23 of the elongate knock-out pins 21. FIGS. 12-15 demonstrate that a conical extension 26 having the annular bead 25 thereon may be used in combination with one or both of the elongate knock-out pins 21 or the internal ribs 20 as means to facilitate holding the form-setting heavy material within the parking bumper shell 10. The conical extension 26 having the annular bead 25 may be employed as the sole means to facilitate holding the form-setting heavy material within the parking bumper shell 10, without either the elongate knock-out pins 21 or the internal ribs 20.

Figure 10:
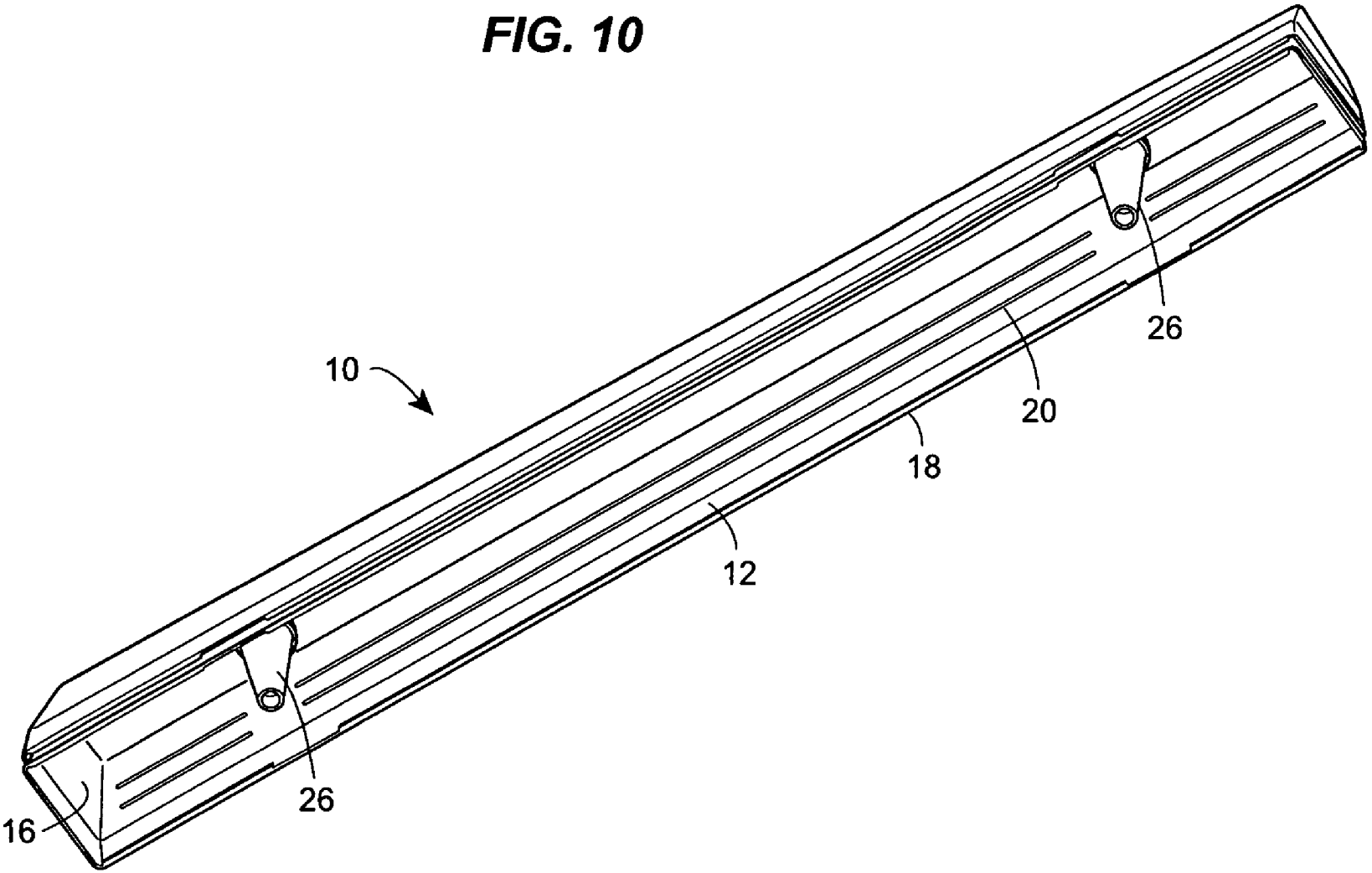
FIG. 10 is a perspective view of two parking bumper shells when nested on top of each other.
Figure 11:
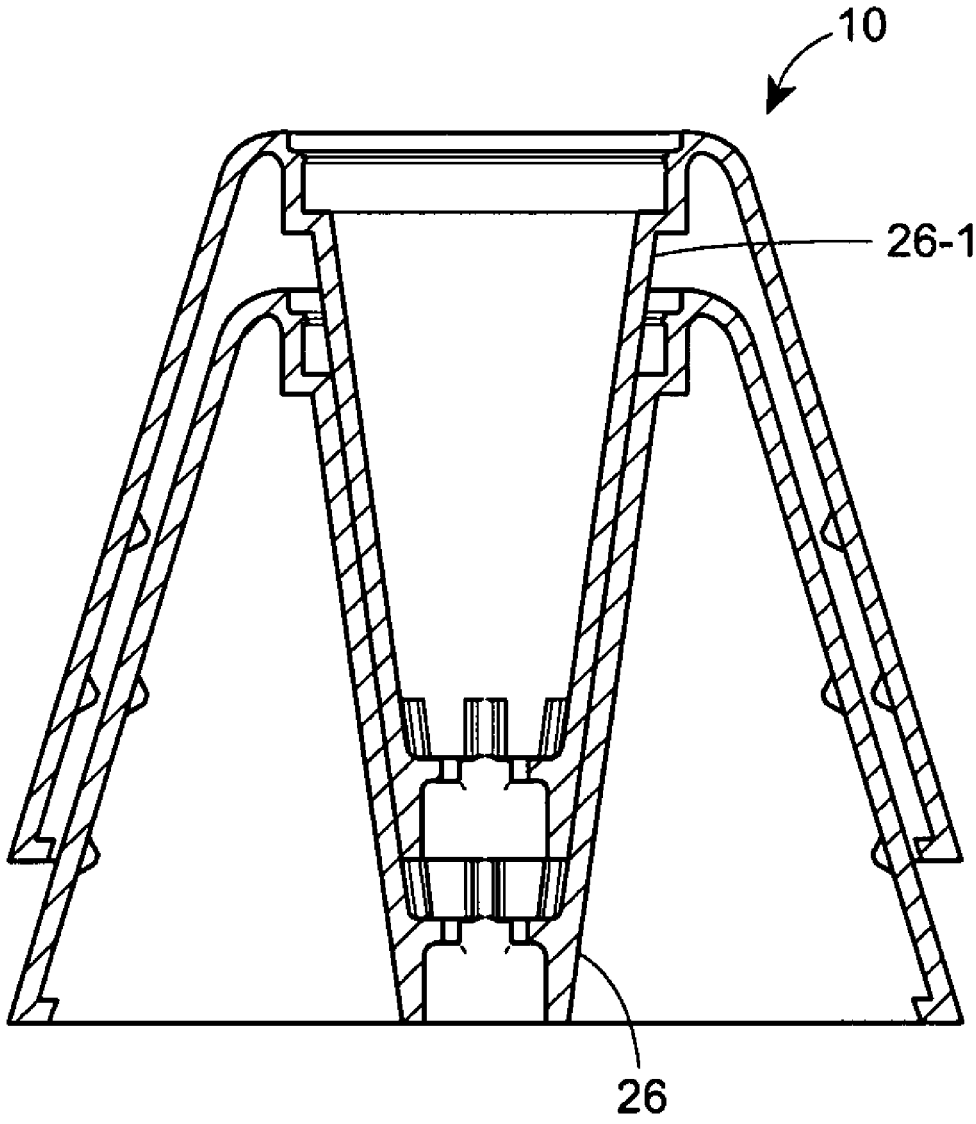
FIG. 11 is a cross-section view of the two parking bumper shells of FIG. 10, showing the nesting of the parking bumper shells and their hollow extensions.
Figure 12:
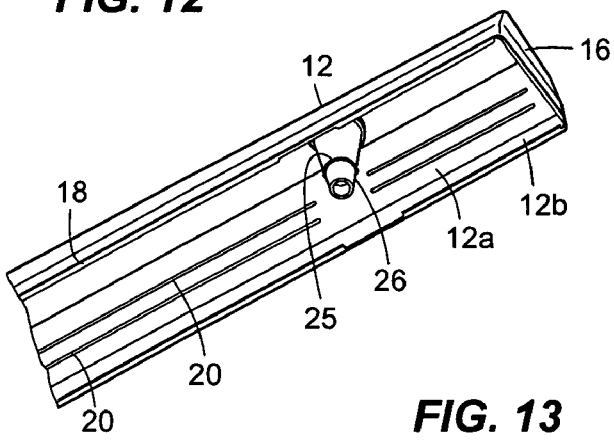
FIG. 12 is a perspective view similar to FIG. 2, partially broken away, showing a hollow conical extension of the parking bumper shell having an annular bead on an exterior surface thereof, in addition to internal ribs.
Figure 13:
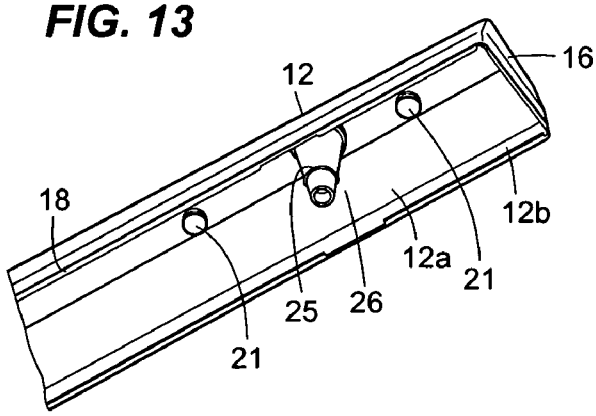
FIG. 13 is a perspective view similar to FIG. 3, partially broken away, showing a hollow conical extension of the parking bumper shell having an annular bead on an exterior surface thereof, in addition to a plurality of elongate knock-out pins.
Figure 14:
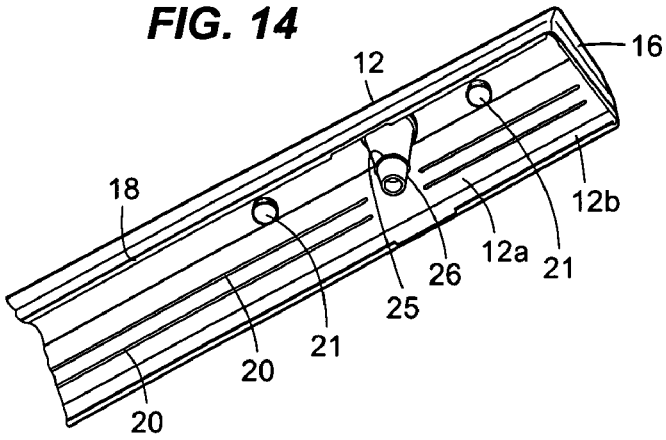
FIG. 14 is a perspective view similar to FIG. 5, partially broken away, showing a hollow conical extension of the parking bumper shell having an annular bead on an exterior surface thereof, in addition to both internal ribs and a plurality of elongate knock-out pins.
Figure 15:
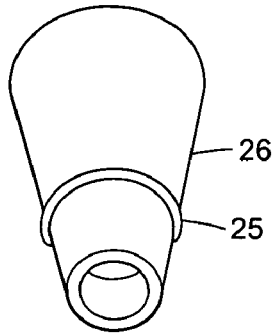
FIG. 15 is a perspective view of a hollow conical extension of the parking bumper shell having an annular bead on an exterior surface thereof.

Referring to FIGS. 10 and 11, the parking bumper shells 10 may be nested on top of one another to conserve space during transportation and storage of the parking bumper shells 10. As shown in FIG. 11, the hollow extensions 26 may be sized to allow for nesting of two or more parking bumper shells 10. Accordingly, the interior of the hollow extensions 26 may be sized to substantially receive an exterior of another hollow extension 26. In a particularly preferred embodiment, two of the parking bumper shells 10 may be nested with only an approximately 1 inch loss (i.e. the combined height of the two parking bumper shells 10 when nested for transit or storage purposes is approximately 1 inch greater than the height of a single parking bumper shell 10).

Figure 7:
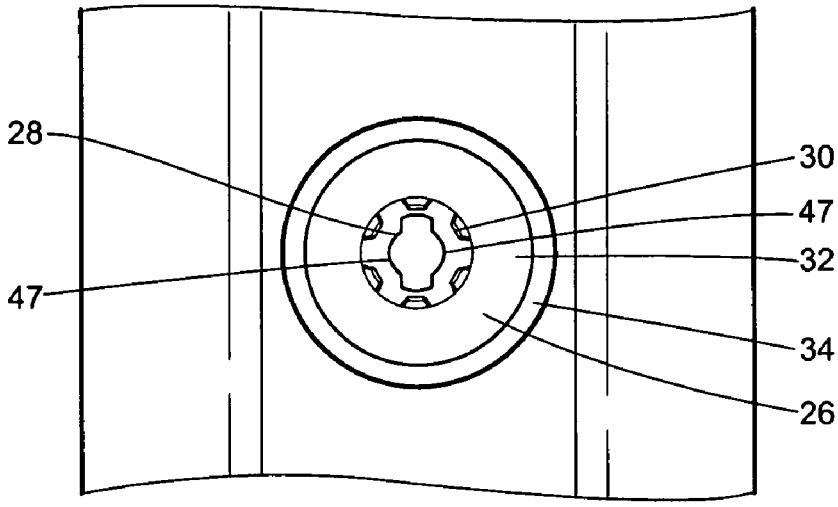
FIG. 7 is a top perspective view of the parking bumper shell of FIG. 1, showing the interior of the hollow extension.

Referring to FIGS. 6 and 7, the hollow extension 26 may include an inwardly projecting neck 28 and inwardly projecting fins 30. The inwardly projecting neck 28 is disposed substantially around an interior circumference of the hollow extension 26. The inwardly projecting neck 28 may be disposed at the lower portion 26*b* of the hollow extension 26. In addition, one or more fins 30 may be provided on the interior of the hollow extension 26. Like the neck 28, the fins 30 project into the interior of the hollow extension 26. The one or more fins 30 may be disposed just above the neck 28. The fins 30 may be spaced evenly about an interior circumference of the hollow extension 26. The fins 30 and the neck 28 can aid in keeping the anchoring post secured in the hollow extension 26. When an anchoring post is placed into the hollow extension 26, the fins 30 and the neck 28 may be pushed against the anchoring post and provide resistance against movement of the anchoring post.

The neck 28 may be formed with keyway tabs 47 that narrow from the top of the neck to the bottom. The keyway tabs 47 are flexible enough to accommodate various sizes of steel reinforcing bar which are commonly used to anchor existing parking bumpers, and which may be inserted into hollow extension 26 as an anchoring post 51, such as ½", ⅝", and ¾" diameter (also known as #4, #5, or #6 size rebar, respectively). Such tabs are so spaced as to also accept other commonly used anchoring posts 51, such as long lag bolts, long carriage bolts, oversized, headed landscape timber spikes, and lengths of metal rod. The narrowing profile of the tabs allows steel reinforcing bar (if used as an anchoring post 51) to slide through easily when it is inserted downward through hollow extension 26 and into the ground at time of parking bumper installation, but the neck 28 tends to grip and resist movement in the opposite direction, as the chamfered-edge keyway tabs 47 (see FIGS. 6 and 7) slightly deform and tightly grip the anchoring post 51 when extended therethrough. The keyway tabs 47 grip steel rebar especially well, because the keyway tabs 47 tend to engage the ridges formed on the surface of rebar. This helps to hold the parking bumper firmly against the parking lot surface, and also helps to prevent the anchoring post 51 from "riding up" out of the parking lot surface over time due to forces from ground freeze and thaw.

Referring to FIG. 7, the opening in the neck 28 may be in the shape of a keyway (approximately that of a rectangle superimposed upon a circle, with their centers at the same point, and with one dimension of the rectangle being greater than the diameter of the circle and the other dimension being less than the diameter of the circle). This shape not only allows for gripping of the anchoring post 51 as described above, but also for the insertion of a lifting tool (with an L- or T-shaped tip extension) that passes through the neck 28 when inserted. Once the lifting tool (not shown) is rotated 90 degrees about the axis of the neck 28, the L- or T-shape on the extension then engages the keyway tabs 47 forming the neck 28, and the lifting tool can then be used to lift the parking bumper. This method can be used to lift the parking bumper when it is in both the inverted and upright positions, as long as no anchoring post 51 is installed in the neck 28 at the time of lifting.

Figure 8:
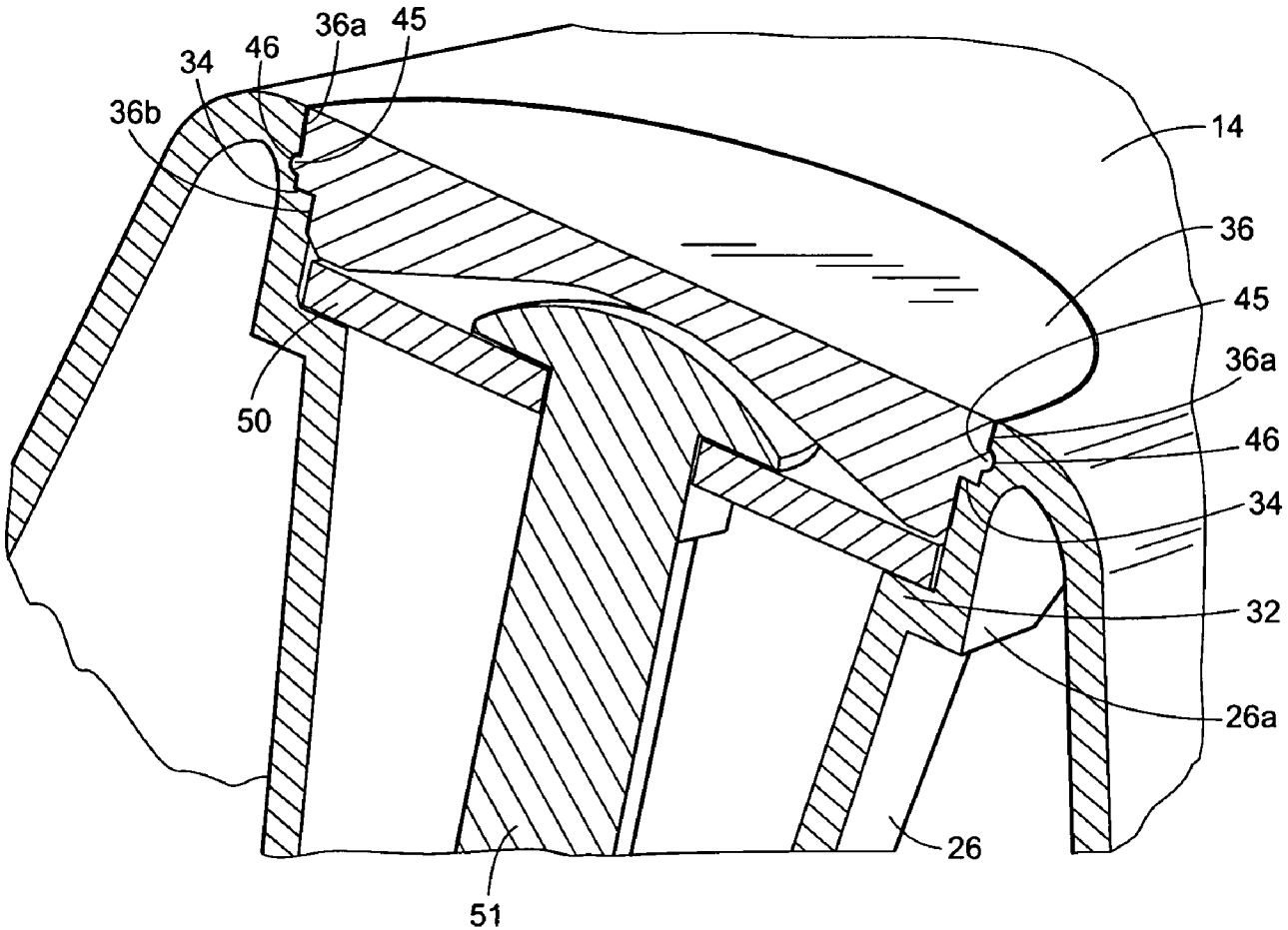
FIG. 8 is a cross-sectional view of the interior of the hollow extension, showing a washer, an anchoring post, and a cap disposed in the hollow extension.

Referring to FIG. 8, the hollow extension 26 may include a ledge 32 that extends outwardly from the interior of the hollow extension 26. The ledge 32 may be disposed in a top portion 26*a* of the hollow extension 26, which is located near the top wall 14. The ledge 32 may be used to support a washer 50 or other means of retention. The ledge 32 may be further adapted to receive a cap 36. To allow for proper positioning and sealing of the cap 36, the ledge 32 may further include a shoulder 34 that is adapted to receive a top portion 36*a* of the cap 36. The shoulder 34 allows the cap 36 to sit within the hollow extension 26 such that the top portion 36*a* of the cap 36 is flush with an exterior of the top wall 14.

Figure 9:
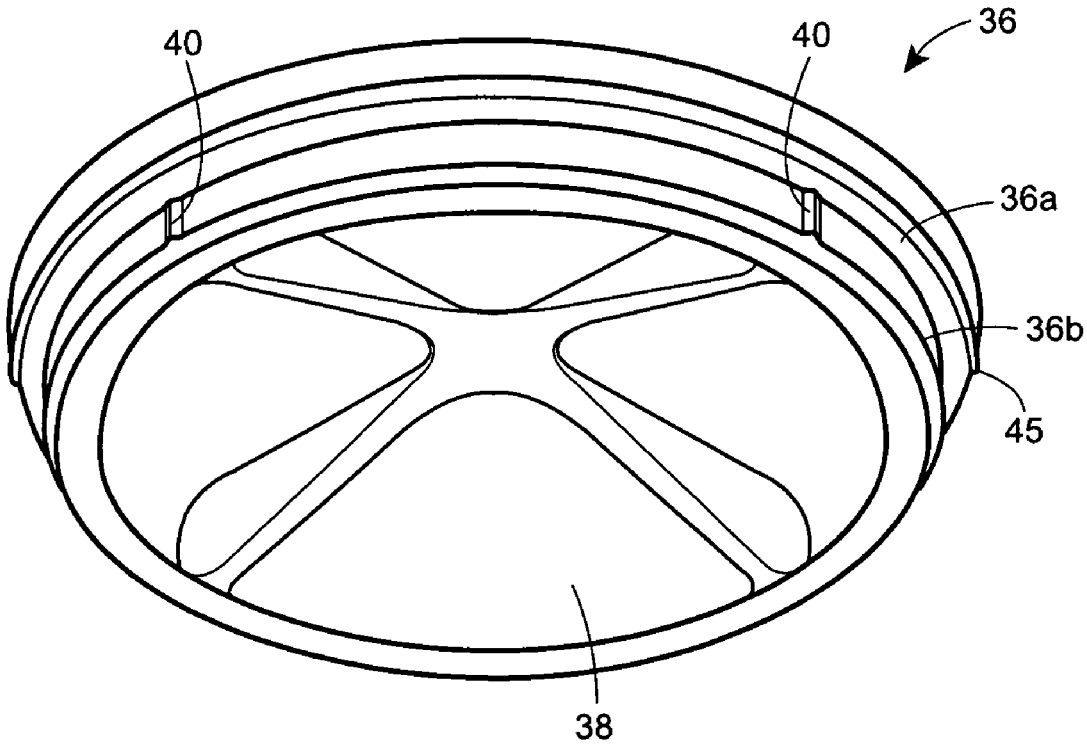
FIG. 9 is a perspective view of the cap.

Referring to FIG. 9, the cap 36 is sized to fit in the top portion 26*a* of the hollow extension 26. The cap 36 may include a top portion 36*a* and a bottom portion 36*b*. The top portion 36*a* may have a diameter that is larger than a diameter of the bottom portion 36*b*. The top portion 36*a* of the cap 36 is adapted to rest adjacent the shoulder 34 of the ledge 32. The bottom portion 36*b* of the cap 36 is adapted to fit within the ledge 32 of the hollow extension 26.

The top portion 36*a* of the cap 36 may also be surrounded by an annular bead 45 which fits into a corresponding annular groove 46 cut into the recess in the top wall 14 just above shoulder 34. The interlocking fit of the annular bead 45 into the annular groove 46 helps to secure the cap 36 into the top wall 14, and may be so tight as to require striking with a rubber mallet for installation. The extremely tight fit of the cap 36 into the parking bumper helps to prevent unauthorized removal (i.e. by prying) of the cap 36 from an installed parking bumper, e.g. after the bumper is anchored to the ground in its desired end-use location with one or more anchoring posts 51, and also inhibits accidental loss due, for example, to adverse weather conditions.

The bottom portion 36*b* of the cap 36 may include an internal recess 38 that tapers upward toward the top portion 36*a* of the cap 36. This recess 38 allows the cap 36 to sit over the anchor post 51.

The bottom portion 36*b* of the cap 36 may also include one or more outwardly projecting ribs 40. The ribs 40 can help to secure the cap 36 within the ledge 32 of the hollow extension 26. The outwardly projecting ribs 40 may have, for example, a semi-circular cross-section, a trapezoidal cross-section, a triangular cross-section, a rectangular cross-section, or any other suitable cross-sectional shape. The ribs 40 vertically extend substantially along a height of the bottom portion 36*b* of the cap 36. The ribs 40 may be spaced evenly about a circumference of the bottom portion 36*b* of the cap 36. Preferably, the ribs 40 extend outwardly approximately ¼ inch from the bottom portion 36*b* of the cap 36.

A method of forming parking bumpers using the parking bumper shells 10 of the present disclosure will now be described. The parking bumpers can be formed at a precaster's site by filling the parking bumper shell 10 with a suitable form-setting heavy filling material, such as concrete or asphalt. Advantageously, such form-setting material may be left-over concrete from other projects that would otherwise go to waste. Alternatively, the parking bumper shells 10 can be located adjacent their final, desired positions at the parking lot, so that once filled with a suitable form-setting heavy filling material the parking bumpers do not again need to be moved (except to be turned upright.)

To prepare the parking bumper shell 10 for filling, the parking bumper shell 10 may be inverted, so that the top wall 14 is disposed against the ground. The parking bumper shell 10 may then be filled, for example, with concrete, asphalt, or any other suitable form-setting heavy filling material. The form-setting heavy filling material may then be tamped if needed. To level the surface of the heavy filling material, a trowel or other suitable leveling tool may be run along the lips 18 of the first and second side walls 12. Any heavy filling material that enters the hollow extensions 26 may easily be removed by any known methods, such as punching out the solidified portions within the hollow extensions 26.

Figure 19:
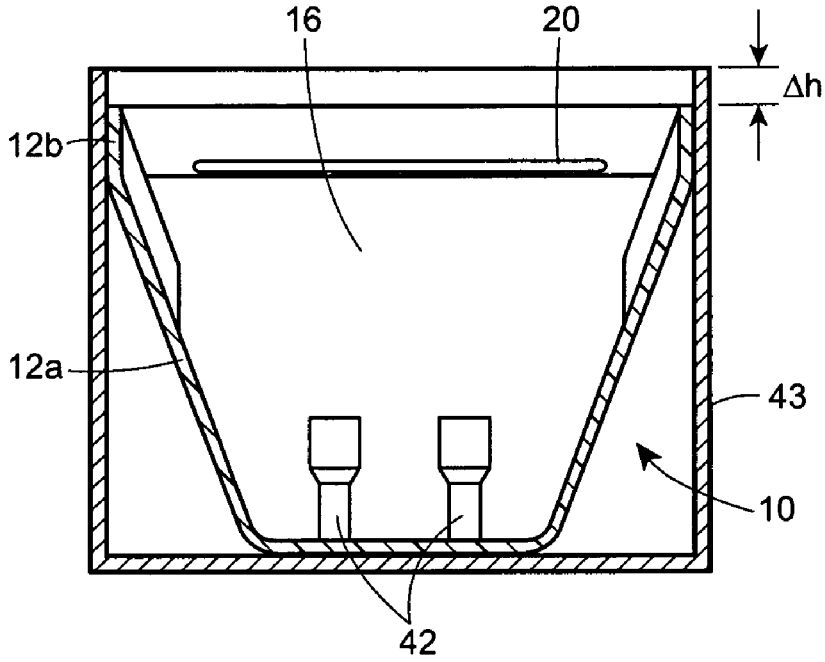
FIG. 19 is a cross-sectional view of the second embodiment of the parking bumper shell placed within the rigid frame member for filling.
Figure 20:
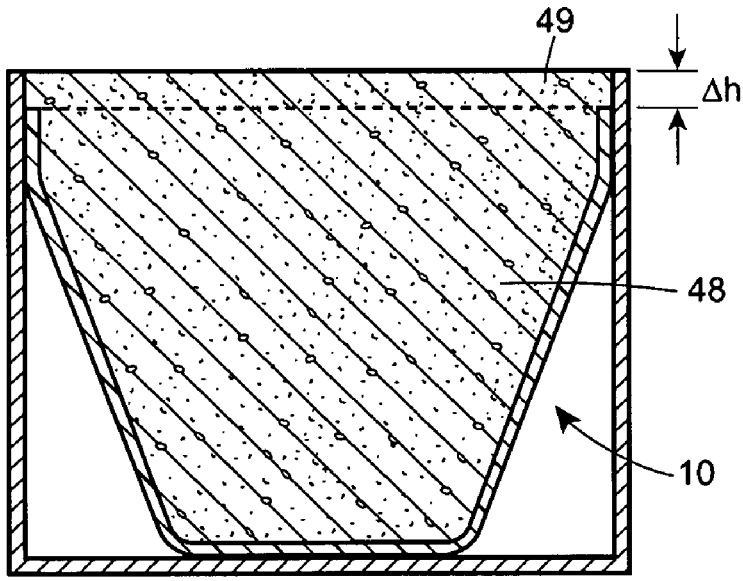
FIG. 20 is a cross-sectional view of a filled parking bumper shell curing inside the rigid frame member.

During filling, the weight of the heavy filling material may cause the side walls 12 of the parking bumper shell 10 to bow outward. This may result in a parking bumper with sides that are not parallel, planar, or square. To prevent this from happening, a rigid frame 43 may be used to support the parking bumper shell 10 during filling (see FIG. 18.) The rigid frame 43 is built of a material strong and rigid enough (such as metal or high-tensile strength styrene plastic), and of dimensions thick enough, to maintain the side walls 12 of the parking bumper shell 10 straight as they are filled with the heavy filling material. The rigid frame 43 is in the form of a box, closed on all sides except the top, with an interior length and width equal to that of the exterior length L and width W of the parking bumper shell 10, and with an interior height that can be greater than, less than, or equal to that of the exterior height H of the parking bumper shell 10. This allows an inverted parking bumper shell 10 to be lowered into the rigid frame 43 from above prior to filling with heavy filling material, with the parking bumper shell's 10 side walls 12 lightly contacting the inner side walls of the rigid frame 43. As previously stated, the height of the side walls of the rigid frame 43 may be less than or equal to the height H of the side walls 12 of the parking bumper shell 10, or may extend slightly higher by an additional clearance Δh. That clearance Δh, for example, could be ⅛ to ¼ inch. FIGS. 19 and 20 show a cross-sectional view of a parking bumper shell 10 placed into the rigid frame 43 before and after filling, respectively.

Once the parking bumper shell 10 has been inverted and placed in the rigid frame 43, it is ready to be filled. Heavy form-setting filler material (i.e. concrete) is poured into the parking bumper shell 10 until it reaches the top of the side walls of the rigid frame 43 if the top of the side walls of the rigid frame 43 extends past the top of the side walls 12 of the parking bumper shell 10. If the top of the side walls of the rigid frame 43 does not extend past the top of the side walls 12 of the parking bumper shell 10, the heavy form-setting filler material is poured into the parking bumper shell 10 until it reaches the top of the side walls 12 of the parking bumper shell 10. A trowel or similar straight-edged tool may be run across the top of the rigid frame 43 or the top of the side walls 12 of the parking bumper shell 10 to level the heavy filling material and remove excess. If the side walls of the rigid frame 43 are less than or equal in height to the height of the parking bumper shell 10 within, the filler material will be flush with the bottom of the side walls 12, end walls 16 and lip 18 (if present). If the side walls of the rigid frame 43 extend above the parking bumper shell 10 by an additional clearance Δh, the filler material will fill the parking bumper shell 10 and also form a base pad 49 of height Δh across the base of the finished parking bumper. The outer edge of the base pad 49 will cover off the bottom free peripheral edge of the side walls 12 and end walls 16. Advantageously, such a base pad keeps the lip 18 or lower edge of the side walls 12 and end walls 16 from scraping against the ground during installation, potentially causing the side walls 12 or end walls 16 to separate from the cured heavy filler material or damaging the parking bumper's exterior, e.g. by cracking the plastic.

To help speed production of parking bumpers at the work site, an alternate method of production may be employed once two or more parking bumpers have been completed. The advantage of this method is that it does not require use of the rigid frame member 43, yet results in a completed parking bumper with planar, parallel, and square sides. Two completed, filled and dried parking bumpers may be inverted and then placed with an empty, inverted parking bumper shell 10 between them such that the lower side wall 12*b* on each completed parking bumper is supporting the same lower side wall 12*b* on the empty bumper in between. The empty parking bumper shell 10 may then be filled with the heavy filling material, and a trowel may be run across the surface of the two surrounding parking bumper shells to level the filling material in the center parking bumper shell. Excess heavy filling material may be wiped or troweled away from the end walls 16 of the just-filled parking bumper shell 10. The parking bumpers on either side may be removed when the heavy filling material inside the parking bumper shell 10 in the center has set.

Yet another method of casting parking bumpers on-site with adequate support for the side walls 12 is to place a plurality of parking bumper shells 10, inverted, into parallel recesses provided in the underside of their shipping pallet (not shown) and fill the parking bumper shells 10 with heavy filling material. Like the rigid frame 43, the shipping pallet is built of a rigid material (e.g. wood) and of a thickness adequate to hold the side walls 12 of the parking bumper shell 10 planar, parallel, and square during shipping. Unlike the rigid frame 43, however, the shipping pallet has several parking bumper shell-shaped recesses to provide a "gang form" for the casting of several parking bumpers simultaneously.

Figure 23:
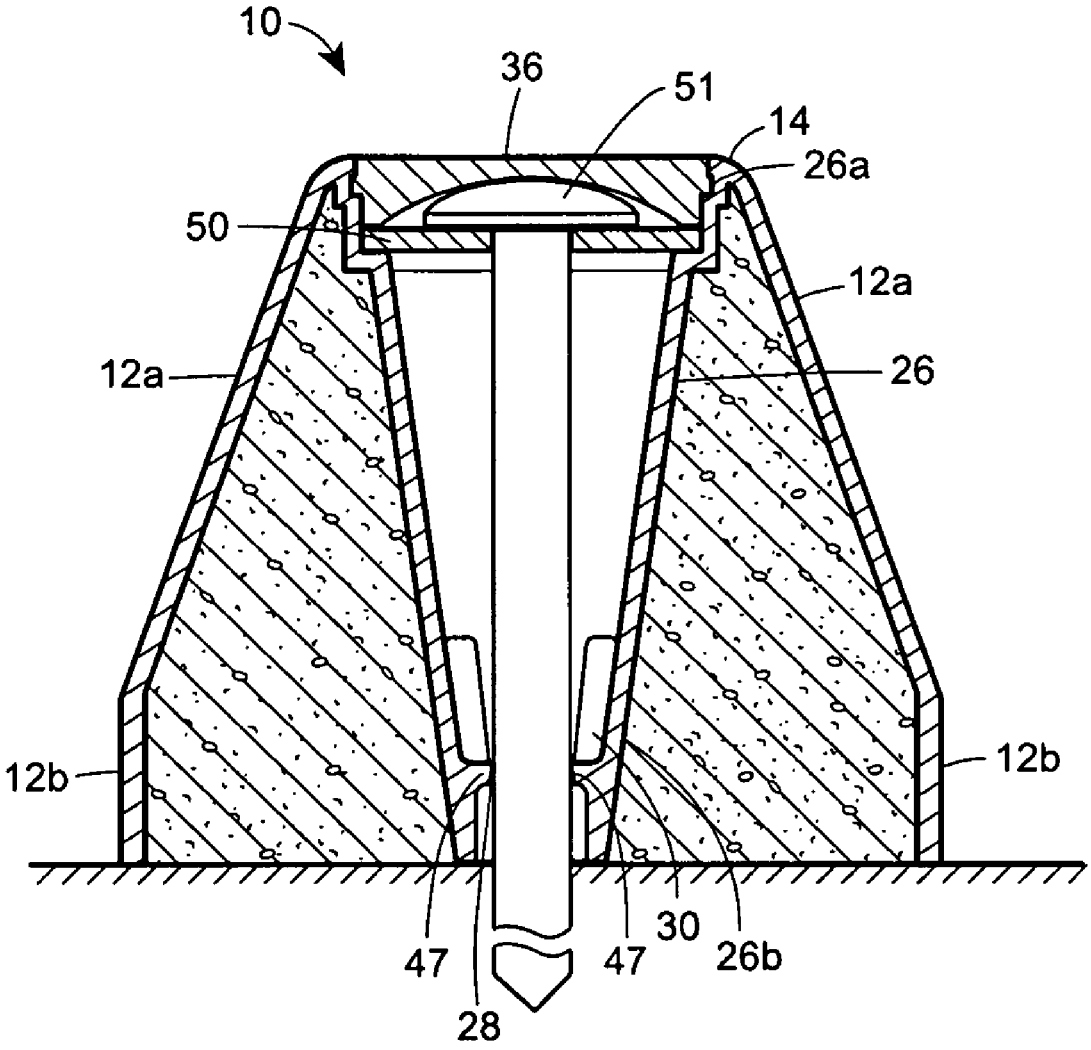
FIG. 23 is a cross-sectional view of the parking bumper showing the anchoring post, washer, and cap fully installed and the parking bumper anchored to the parking surface.

After the heavy filling material solidifies, the parking bumper may be lifted from the rigid frame using the above-described lifting tool (if the rigid frame is used,) transported to the desired parking lot or other location, and flipped upright at the desired, final location of the parking bumper. The undercut wings 41, internal ribs 20, lips 18, and/or elongate knock-out pins 21 or 42 serve to secure the solidified heavy filling material and the parking bumper shell 10 together. Once the parking bumper is properly situated, anchor posts, e.g. suitably-sized rebar rods, may then be driven through the hollow extensions 26 into the parking lot using, for example, an impact drill. Alternatively, a lag shield and lag bolt may be placed in the hollow extensions 26 and received in the washer 50. The lag bolt may then be tightened into place on the parking bumper using a ratchet wrench. The cap 36 may then be placed and secured in the ledge 32 of the hollow extensions 26, using a mallet or hammer, for example. Any heavy filler material that enters or obstructs the neck 28 during casting will be easily cleared away by hammering when the anchoring post is inserted and hammered into place. FIG. 23 shows a cutaway view of a parking bumper fully installed, with a representative anchoring post 51 used to secure the parking bumper to the parking lot surface.

By forming parking bumpers using the parking bumper shells 10, the cost of the parking bumpers can be greatly reduced. The parking bumper shells 10 are inexpensive to produce and the pouring of the parking bumpers at a precaster's site using the parking bumper shells 10 is not very labor intensive. Also, prior art parking bumpers are typically produced using about eleven feet total of ½" steel rebar cast into the concrete, which serves to prevent crack propagation in the concrete from causing a portion of the bumper to fracture off. In the present parking bumper, steel rebar does not need to be cast into the body of the parking bumper, because the plastic outer shell and the undercut features serve to hold the concrete in place, even if cracking of the filler material does occur within the parking bumper shell. In a prior art parking bumper, the rebar required to reinforce the concrete structure of the bumper contributed about half of the total material cost for that bumper, whereas in the present parking bumper, the cost of that steel rebar (and the labor to cut and install it) is avoided entirely. Additionally, precaster sites can maintain a supply of parking bumper shells 10 on site, and utilize left-over ready-mix or other heavy filling material to form parking bumpers. Moreover, the unfilled parking bumper shells 10 are relatively light as compared to conventional concrete parking bumpers and can be nested on top of each other. Thus, transportation, storage, and retail display space can be more efficiently used and overall associated costs can be greatly reduced. Thus, the parking bumper shells 10 of the present disclosure are suitable for sale at lumber yards or other home improvement stores, as a kit, together with Sakrete®, Quikrete®, or any other ready-mix concrete or heavy filling material mix, with or without a trowel or similar leveling tool, for do-it-yourself or independent contractor use.

While various embodiments have been described above, this disclosure is not intended to be limited thereto. Variations can be made to the disclosed embodiments that are still within the scope of the appended claims.

What is claimed is:

1. A parking bumper shell formed of injection-molded plastic, to be later filled with a form setting heavy filling material, comprising:

a top wall;

first and second side walls respectively extending from opposite sides of the top wall;

first and second end walls respectively extending from opposite sides of the top wall, and respectively connecting adjacent ends of the respective first and second side walls, so as to form an open-bottom chamber;

one or more undercuts formed on one or more of the top wall, first side wall, and second side wall, and extending inward along at least one of the first or second side wall; and at least one inwardly-projecting extension, formed on the top wall, for retainably holding an anchoring post used to secure a filled parking bumper shell to a ground or other supporting surface, wherein the inwardly projecting extension is sized to receive an inwardly projecting extension of a second parking bumper shell when the parking bumper shells are nested, wherein each inwardly projecting extension has a ledge to receive an associated washer to seat an associated anchoring post, and a cap to cover off the inwardly projecting extension when the anchoring post is seated therewithin, and wherein each inwardly projecting extension further comprises:

an inwardly projecting neck for securing the anchoring post within the inwardly projecting extension; and one or more inwardly projecting fins for securing the anchoring post within the inwardly projecting extension, wherein the inwardly projecting fins are disposed above the inwardly projecting neck, wherein the neck includes a neck opening formed therein for grippingly receiving a parking surface-engaging anchoring post extended therethrough, to assist in selectively securing the parking bumper shell to the ground, and wherein the opening comprises a keyway-shaped aperture, the periphery of which is adapted to partially deform, depending upon the overall outer dimension of the ground-engaging anchoring post extended therethrough, to thereby enable gripping receipt of a plurality of different sizes of such ground-engaging anchoring posts.

2. The parking bumper shell of claim 1. wherein the one or more undercuts comprise at least one internal rib formed on each of the first and second side walls, each internal rib extending inwardly and aligned generally parallel to the top wall.

3. The parking bumper shell of claim 2, wherein each internal rib extends at least approximately two-thirds a length of the associated side wall.

4. The parking bumper shell of claim 2, wherein first and second side walls each have two internal ribs formed thereon.

5. The parking bumper shell of claim 4, wherein each internal rib extends inwardly of the respective first and second side walls by at least ¼ inch.

6. The parking bumper shell of claim 2, wherein each internal rib is formed of a series of disjointed ribs.

7. The parking bumper shell of claim 1, wherein the one or more undercuts comprise one or more elongate knock-out pins formed on and extending inwardly from the top wall, wherein a thickness along a portion of the elongate knock-out pins reduces to provide a notch to accept the heavy filling material.

8. The parking bumper shell of claim 7, wherein the notch is formed at a portion of the one or more elongate knock-out pins at which the thickness of the elongate knock-out pin reduces at a constant rate.

9. The parking bumper shell of claim 7, wherein at a thinnest point, each of the one or more elongate knock-out pins has a thickness of about half of a thickness at a thickest part of the one or more elongate knock-out pins.

10. The parking bumper shell of claim 7, wherein each of the one or more elongate knock-out pins have a length of approximately ⅜ inch.

11. The parking bumper shell of claim 7, wherein each of the one or more elongate knock-out pins have a thickness of approximately ⅜ inch.

12. The parking bumper shell of claim 1, wherein a logo plate is formed on at least one of the first and second side walls and top wall to receive signage indicia, said logo plate being one of recessed into, flush with, or raised from said at least one of the first and second side walls and top wall.

13. The parking bumper shell of claim 1, further comprising an inwardly projecting lip formed at a bottom edge of each of the respective first and second side walls, the lip providing a surface to level the heavy filling material so as to achieve, once such material has set, a flat surface for the filled parking bumper shell to rest on.

14. The parking bumper shell of claim 13, wherein the lip projects inwardly ¼ inch from each of the first and second side walls.

15. The parking bumper shell of claim 1, wherein the cap includes at least one outwardly projecting rib for securing the cap within the inwardly projecting extension.

16. The parking bumper shell of claim 1, wherein each of the respective first and second side walls has a first portion that is outwardly-tapered, and a second portion extending generally vertically from a bottom of that first portion.

17. The parking bumper shell of claim 1, wherein at least a portion of an outer surface of the parking bumper shell includes color indicia for signifying particular permitted parking purposes.

18. The parking bumper shell of claim 1, wherein each of the inwardly-projecting extensions is conical in shape.

19. The parking bumper shell of claim 18, wherein each of the inwardly-projecting extensions includes at least one annular bead on an exterior thereof.

20. The parking bumper shell of claim 1, with inwardly-projecting wing members mounted to one of the top wall, first and second side walls, first and second end walls, and combinations thereof.

21. The parking bumper shell of claim 20, where the wing members are mounted to the first and second side walls, and extend toward the peripheral free edge of the first and second side walls, to be embedded in the form-setting heavy filling material, thereby to prevent any substantial separation from the form-setting heavy filling material at the peripheral free edge of the first and second side walls, and of the bumper first and second side walls from the filling material, once the parking bumper shell is filled with such form setting heavy filling material.

22. The parking bumper shell of claim 20, wherein the wing members are formed as at least one pair of extended ribs, each wing member of the pair respectively aligned at an angle to the transverse direction of the first and second side walls.

23. The parking bumper shell of claim 22, and wherein each wing member of the pair is aligned at an angle to the other wing member of the pair.

24. The parking bumper shell of claim 22, and wherein the plane of orientation of each wing member is perpendicular to the base of the parking bumper shell.

25. The parking bumper shell of claim 1, wherein the ground-engaging anchoring posts comprise one of a plurality of different sizes of metal reinforcing bar members.

26. The parking bumper shell of claim 25, wherein said metal reinforcing bar members comprise one of the nominal outer dimension sizes of ½", ⅝", and ¾".

27. The parking bumper shell of claim 1, wherein the opening comprises a keyway-shaped aperture, so sized as to receive a lifting handle tool having an L- or T-shaped operating tip, for the purposes of using the tool, once releasably engaged and turned 90 degrees within the keyway-shaped opening, to enable lifting and moving of the form-setting material-filled parking bumper shell.

28. The parking bumper shell of claim 1, and a removable and reusable rigid frame member adapted to permit nested, encapsulated support of the upturned parking bumper shell during filling thereof with the form-setting heavy filling material, to prevent any outward deformity or non-linear alignment of the first and second side walls during the filling process.

29. The parking bumper shell of claim 28, wherein the outer free peripheral edge of the rigid frame member extends to a greater distance than the outer free peripheral edge of the parking bumper shell once nested therewithin during the filling process. whereby the presence of the extended outer free peripheral edge of the rigid frame permits, during the filling process, a base pad of cast form-setting heavy filling material to cover off and embed the outer free peripheral edge of the parking bumper shell.

30. The parking bumper shell of claim 1, wherein the one or more undercuts comprise inwardly-extending lug members having Z-shaped wedges formed therein, to receive heavy filling material during the filling process, to secure the parking bumper shell to the form-setting heavy filling material.

31. A parking bumper shell formed of injection-molded plastic, comprising:

a top wall;

first and second side walls respectively extending from opposite sides of the top wall;

first and second end walls respectively extending from opposite sides of the top wall, and respectively connecting adjacent ends of the respective first and second side walls, so as to form an open-bottom chamber; and at least one inwardly-projecting extension, formed on the top wall, for retainably holding an anchoring post used to secure the parking bumper shell to a ground or other supporting surface, wherein each inwardly projecting extension has a ledge to receive an associated washer to seat an associated anchoring post and a cup to cover off the inwardly projecting extension when the anchoring post is seated therewithin, and wherein each inwardly projecting extension further comprises:

an inwardly projecting neck for securing the anchoring post within the inwardly projecting extension; and one or more inwardly projecting fins for securing the anchoring post within the inwardly projecting extension, wherein the inwardly projecting fins are disposed above the inwardly neck.

32. The parking bumper shell of claim 31, wherein the inwardly projecting extension is sized to receive an inwardly projecting extension of a second parking bumper shell when the parking bumper shells are nested.

33. The parking bumper shell of claim 31, wherein each of the inwardly-projecting extensions is conical in shape.

34. The parking bumper shell of claim 31, wherein the neck includes a neck opening formed therein for grippingly receiving a parking surface-engaging anchoring post extended therethrough, to assist in selectively securing the parking bumper shell to the ground.

35. The parking bumper shell of claim 31, further comprising one or more undercuts formed on one or more of the top wall, first side wall, and second side wall, and extending inward along at least one of the first or second side wall.

36. The parking bumper shell of claim 35, wherein the one or more undercuts comprise at least one internal rib formed on each of the first and second side walls, each internal rib extending inwardly and aligned generally parallel to the top wall.

37. The parking bumper shell of claim 35, wherein the first and second side walls each have two internal ribs formed thereon.

38. The parking bumper shell of claim 35, wherein each internal rib is formed of a series of disjointed ribs.

39. The parking bumper shell of claim 35, wherein the one or more undercuts comprise one or more elongate knock-out pins formed on and extending inwardly from the top wall, wherein a thickness along a portion of the elongate knock-out pins reduces to provide a notch to accept the heavy filling material.

40. The parking bumper shell of claim 39, wherein the notch is formed at a portion of the one or more elongate knock-out pins at which the thickness of the elongate knock-out pin reduces at a constant rate.

41. The parking bumper shell of claim 39, wherein at a thinnest point, each of the one or more elongate knock-out pins has a thickness of about half of a thickness at a thickest part of the one or more elongate knock-out pins.

42. The parking bumper shell of claim 39, wherein each of the one or more elongate knock-out pins has a length of approximately ⅜ inch and a thickness of approximately ⅜ inch.

43. The parking bumper shell of claim 35, wherein the one or more undercuts comprise inwardly-extending lug members having Z-shaped wedges formed therein, to receive heavy filling material during the filling process, to secure the parking bumper shell to the form-setting heavy filling material.

44. The parking bumper shell of claim 31, with inwardly-projecting wing members mounted to one of the top wall, first and second side walls, first and second end walls, and combinations thereof.

45. The parking, bumper shell of claim 44, where the wing members are mounted to the first and second side walls, and extend toward the peripheral free edge of the first and second side walls, to be embedded in the form-setting heavy filling material, thereby to prevent any substantial separation from the form-setting heavy filling material at the peripheral free edge of the first and second side walls, and of the bumper first and second side walls from the filling material, once the parking. bumper shell is filled with such form setting heavy filling material.

46. The parking bumper shell of claim 31, further comprising an inwardly projecting lip formed at a bottom edge of each of the respective first and second side walls, the lip providing a surface to level the heavy filling material so as to achieve, once such material has set, a flat surface for the filled parking bumper shell to rest on.

47. The parking bumper shell of claim 31, and a removable and reusable rigid frame member adapted to permit nested, encapsulated support of the upturned parking bumper shell during filling thereof with the form-setting heavy filling material, to prevent any outward deformity or non-linear alignment of the first and second side walls during the filling process.

48. The parking bumper shell of claim 31, wherein the cap includes at least one outwardly projecting rib for securing the cap within the inwardly projecting extension.

49. The parking bumper shell of claim 31, wherein each of the inwardly-projecting extensions includes at least one annular bead on an exterior thereof.

50. The parking bumper shell of claim 31, wherein the ground-engaging anchoring posts comprise one of a plurality of different sizes of metal reinforcing bar members.

51. The parking bumper shell of claim 31, wherein the opening comprises a keyway-shaped aperture, so sized as to receive a lifting handle tool having an L- or T-shaped operating tip, for the purposes of using the tool, once releasably engaged and turned 90 degrees within the keyway-shaped opening, to enable lifting and moving of the form-setting material-filled parking bumper shell.

52. The parking bumper shell of claim 31, wherein each of the respective first and second side walls has a first portion that is outwardly-tapered, and a second portion extending generally vertically from a bottom of that first portion.

* * * * *